US008137017B2

(12) United States Patent
Beardsley

(10) Patent No.: US 8,137,017 B2
(45) Date of Patent: Mar. 20, 2012

(54) SELECTIVELY COUPLING A DEVICE TO A CARRIAGE

(75) Inventor: Dwight Beardsley, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 870 days.

(21) Appl. No.: 12/199,045

(22) Filed: Aug. 27, 2008

(65) Prior Publication Data

US 2010/0054836 A1 Mar. 4, 2010

(51) Int. Cl.
*B41J 11/68* (2006.01)
*B41J 2/01* (2006.01)

(52) U.S. Cl. ..... 400/621; 400/352; 400/353; 347/37

(58) Field of Classification Search ..... 400/621, 400/283, 352, 353, 355, 357; 347/37
See application file for complete search history.

(56) References Cited

U.S. PATENT DOCUMENTS

| | | | | |
|---|---|---|---|---|
| 5,321,892 | A * | 6/1994 | Sasada | 33/18.1 |
| 6,373,573 | B1 | 4/2002 | Jung et al. | |
| 6,905,187 | B2 | 6/2005 | Arquilevich et al. | |
| 7,121,750 | B2 * | 10/2006 | Iwase et al. | 400/354 |
| 7,422,386 | B2 * | 9/2008 | Ohmori et al. | 400/621 |

FOREIGN PATENT DOCUMENTS

| | | | |
|---|---|---|---|
| GB | 2295584 | A * | 6/1996 |
| JP | 09029685 | A * | 2/1997 |

* cited by examiner

*Primary Examiner* — Daniel J Colilla
(74) *Attorney, Agent, or Firm* — William R. Zimmerli

(57) ABSTRACT

A printing apparatus that selectively couples a device to a printer carriage is provided. The printing apparatus includes a printer carriage and an intervening mechanism. The printer carriage is movable back and forth to selectively retrieve the device from and return the device to a position where the device can be parked detached from the carriage. The carriage is arranged to selectively move back and forth relative to the device while the device is detached from the carriage and in unison with the device while the device is attached to the carriage. The intervening mechanism and the carriage have respective surfaces that engage as they meet each other to allow the carriage to move past the intervening mechanism.

13 Claims, 26 Drawing Sheets

SELECTIVELY COUPLING A DEVICE TO A CARRIAGE

FIELD OF THE INVENTION

The present invention relates generally to selectively coupling a device, such as an optical measurement device, to a carriage, such as a printer carriage while moving past an intervening mechanism, such as an activator for a cutting tool.

BACKGROUND OF THE INVENTION

Referring to FIG. 1, one example of a wide format ink jet printer 10 includes right and left side housings 72, 74, and is supported by a pair of legs 76. The right housing 72, shown in FIG. 1 with a display and keypad for operator input and control, encloses various electrical and mechanical components related to the operation of the printer 10. The left housing 74 encloses ink reservoirs 86 which feed ink to the ink-jet printheads 82 via plastic conduits 84, which run between each ink-jet printhead 82 and each ink reservoir 86. In some printer embodiments, no separate ink reservoirs 86 or tubing 84 is provided, and printing is performed with ink reservoirs integral to the printheads. Housing 72 or 74 may also include a maintenance station to clean and cap the printheads as needed. A printing region extends all or part of the way between the two housings 72 and 74.

Either a roll of continuous print media (not shown) is mounted to a roller on the rear of the printer 10 to enable a continuous supply of paper to be provided to the printer 10 or individual sheets of paper (not shown) are fed into the printer 10. In the case of roll-fed media, the media is cut after printing an image. A platen 78 forms a horizontal surface which supports the print media, and printing is performed by selective deposition of ink droplets onto the paper. During operation, a continuous supply of paper is guided from the roll of paper mounted to the rear of the printer 10 across the platen 78 by a plurality of rollers (not shown) which are spaced along the platen 78.

Print carriage 12 is supported above the platen 78 by primary guide rail 70. The print carriage 12 includes a plurality of ink-jet printheads 82 mounted therein. In the example shown in FIG. 1, four printheads 82 are mounted on the print carriage 12, although it is contemplated that any number ink-jet printheads 82 can be provided. A motor and a drive belt mechanism (not shown) are used to drive the print carriage 12 back and forth along the primary guide rail 70, as denoted by bidirectional arrow 80.

For high quality printing, it is sometimes necessary to monitor the characteristics of the printed image. For example, a spectrophotometer may be used to measure the colors being provided by the printed ink, relative to the intended colors. If it is found that the colors are outside the desired range, then adjustments may be made. Such adjustments may include cleaning of the printhead, adjusting the drop size ejected by the printhead, or adjusting the number of droplets ejected for providing a particular desired color, for example.

When permanently affixing an optical measurement device, such as a spectrophotometer to a printer carriage, the mass of the carriage is significantly increased when the device is mounted to it, thereby requiring more expensive rail and motor systems in the printer to compensate for the increased mass, particularly for high throughput printing requiring high velocity and acceleration of the printhead carriage. Also, for the case of an inkjet printing system, the optical measurement device is unable to make precise measurements when it is contaminated with ink mist and it can be difficult to shield the device adequately from the ink mist when it is mounted so closely to the source of the ink mist generation (e.g. when the optical device is mounted next to the printheads during printing).

Accordingly, there is a need in the art for an apparatus and method for selectively coupling a device, such as an optical measurement device, to a carriage, such as a printer carriage, as needed so that the optical measurement device does not spend its life span mounted to the carriage. In doing so, it may be necessary to move components of the printing system in a manner that gives the carriage a path to reach the optical measurement device even through there may be an intervening mechanism, such as an activation mechanism for a media cutting tool, in a path between the printing region of the carriage and the optical measurement device in its parked position.

SUMMARY OF THE INVENTION

Therefore, aspects of the invention are directed to providing an apparatus and method for selectively coupling a device, such as an optical measurement device, to a carriage, such as printer carriage, after moving past an intervening mechanism, such as a cutter activation mechanism.

According to one aspect of the invention, a printing apparatus that selectively couples a device to a printer carriage is provided. The printing apparatus includes a printer carriage and an intervening mechanism. The printer carriage is movable back and forth to selectively retrieve the device from and return the device to a position where the device can be parked detached from the carriage. The carriage is arranged to selectively move back and forth relative to the device while the device is detached from the carriage and in unison with the device while the device is attached to the carriage. The intervening mechanism and the carriage have respective surfaces that engage as they meet each other to allow the carriage to move past the intervening mechanism.

According to another aspect of the invention, a method of selectively coupling a device to a printer carriage includes providing a carriage moveable along a travel path including a printing region, the carriage including a printhead and a media cutter; providing a device located at a parked position; providing a media cutter actuation mechanism deployed along the travel path between the printing region and the parked position of the device; optionally actuating the media cutter by causing the carriage to engage the media cutter actuation mechanism, the carriage then returning to the printing region of the travel path with the media cutter being actuated, or optionally causing the carriage to move past the media cutter actuation mechanism and couple to the device; the carriage then returning to the printing region of the travel path without the media cutter being actuated.

According to one aspect of an embodiment of the invention, one of the printer carriage and the optical measurement device includes a hook and the other of the printer carriage and the optical measurement device includes a latch mechanism. The hook connects with the latch mechanism to couple the optical measurement device to the printer carriage. The optical measurement device moves with the printer carriage in the printer when the optical measurement device is coupled to the printer carriage. The latch mechanism is adapted to disengage from the hook when the optical measurement device is returned to a parking position.

According to another aspect of an embodiment of the invention, the printer frame includes a latch retractor mechanism that holds the latch mechanism in a retracted state when the optical measurement device is in a parking position. The printer carriage couples with the optical measurement device when the hook mechanism engages the latch mechanism such that the latch mechanism is released from the latch retractor mechanism and extends to an unretracted state to connect with the hook. When the printer carriage returns the optical measurement device to a parking position, the hook facilitates engagement of the latch mechanism with the latch retractor mechanism such that the latch mechanism returns to a retracted state that is held by the latch retractor mechanism. With the latch mechanism retracted, the hook is disengaged such that the printer carriage is able to move within the printer without being coupled to the optical measurement device.

According to an aspect of another embodiment the invention, the printer includes a printing region, a parking position for a selectively connectable optical measurement device, and a cutter activation mechanism which is located between the parking position and the printing region. The printer carriage is selectively connectable with the optical measurement device, and includes a cutting device that may be activated by the cutter activator. The cutting device can include a tab extending from a yoke that holds the axle for the cutting wheel. As the printer carriage moves from the printing region towards the cutter activator, the cutter activator engages one side of the tab to activate the cutting wheel for a cutting operation within the printer. After engaging the tab, if the printer carriage is moved further toward the parking region, the cutter activator is moved aside by the tab to enable the printer carriage to move past the cutter activator to allow the carriage to couple with the optical measurement device. After connecting with the optical measurement device, the printer carriage is moved back toward the printing region for optical measurements. On the way to the printing region, the tab engages the other side of the cutter activator to deactivate the cutting wheel. The tab then causes the cutter activator to move away from the tab to enable the printer carriage to move past the cutter activation mechanism within the printer.

BRIEF DESCRIPTION OF THE DRAWINGS

These and other objects of the invention will become more fully apparent from the following description and appended claims taken in conjunction with the following drawings, where like reference numbers indicate identical or functionally similar elements.

DETAILED DESCRIPTION OF THE INVENTION

The present invention will be directed in particular to elements forming part of, or cooperating more directly with, apparatus and methods in accordance with the present invention. It is to be understood that elements not specifically shown or described may take various forms well known to those skilled in the art.

Figure 1:
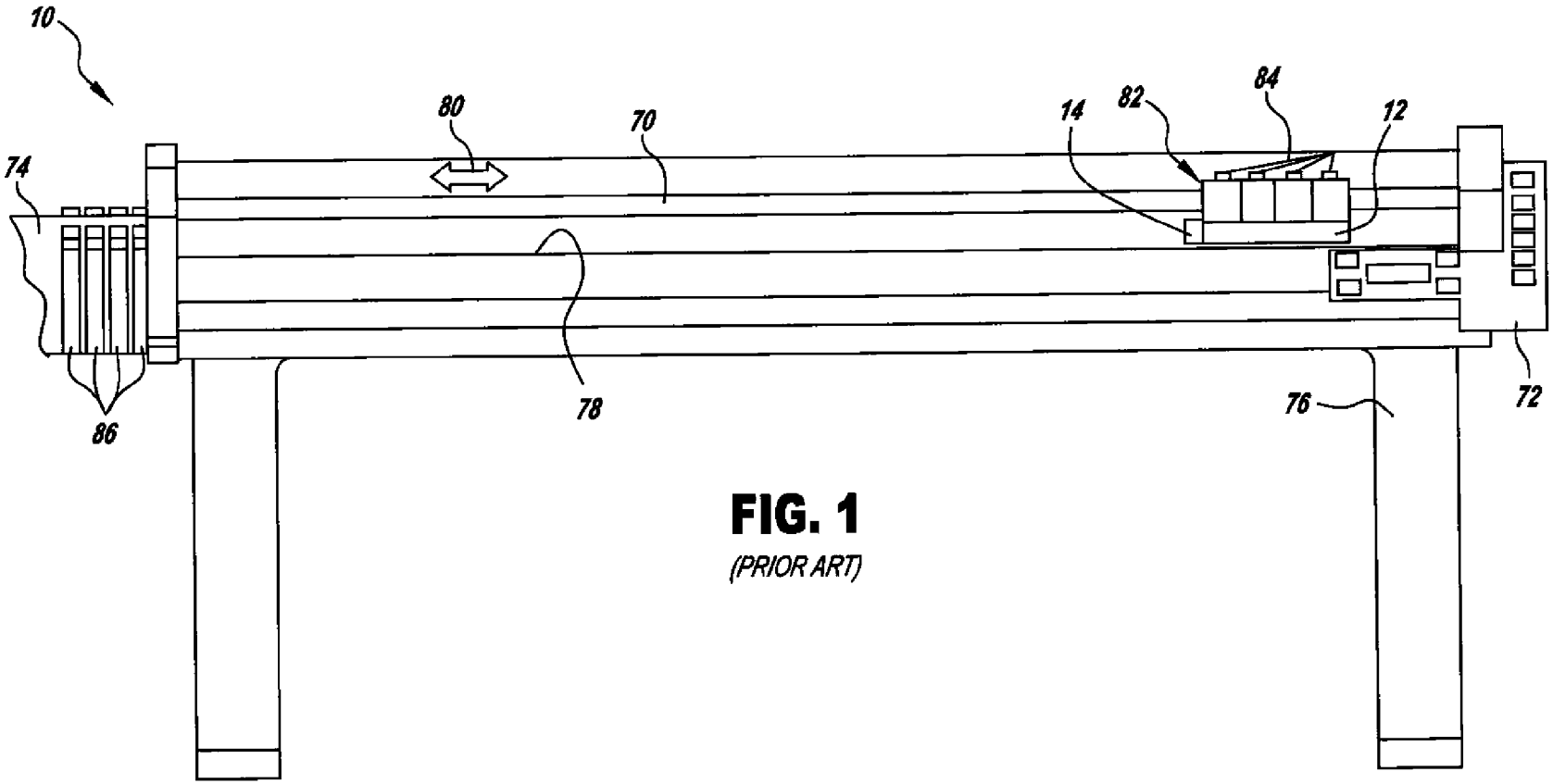
FIG. 1 (PRIOR ART)
FIG. 1 is a front view of a conventional wide format ink jet printer.
Figure 2:
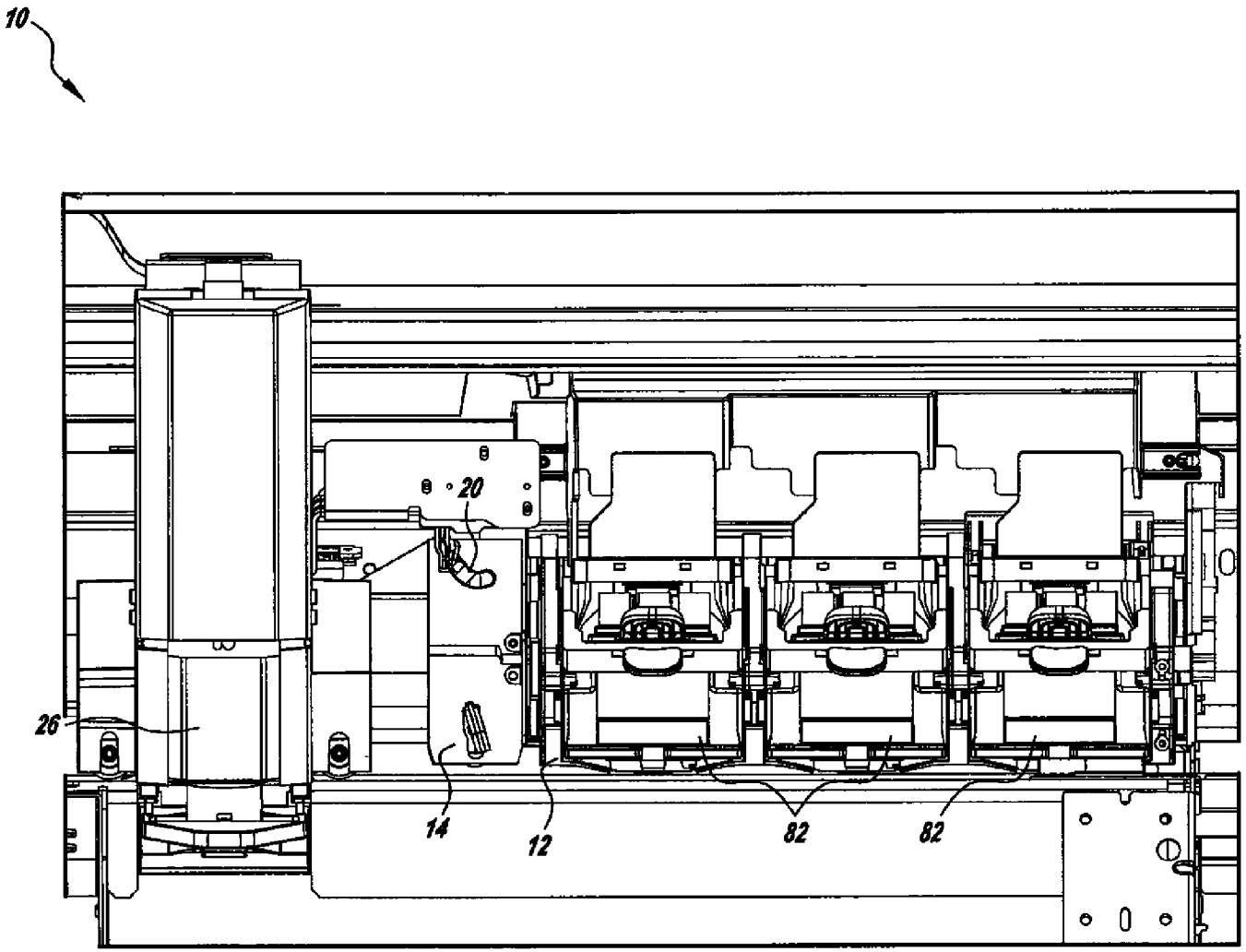
FIG. 2 is a perspective view of a portion of a wide format ink jet printer according to aspects of embodiments of the invention.

Referring to FIG. 2, an example of a portion of wide format ink jet printer 10 is shown including a printer carriage 12 and a cutting device 14 that is used for cutting paper in the printer. Cutting device 14 is mounted on printer carriage 12, for example, by screws. Referring to FIG. 1, during printing, printheads 82 eject ink to form an image as the carriage 12 is scanned back and forth along scan direction arrow, with media being advanced between successive scans. The cutting blade of cutting device 14 needs to be withdrawn during printing, or the image would be sliced into strips. As described in more detail below with reference to FIGS. 3A-3B, cutting device 14 includes a tab 20 that moves cutting wheel 16 up into a withdrawn position, or down into a cutting position, depending on the position of tab 20. In the present example, a cutter activator (described below) is located in left housing 74, while a cutter deactivator is located in right housing 72. During normal printing, the printing carriage does not travel far enough out of the printing region toward the left housing 74 or to the right housing 72 for the tab 20 of cutting device 14 to engage either the cutter activator or the cutter deactivator. However, after the image has been printed and is ready to be separated from the media supply, the carriage 12 moves to the left housing 74 in order to activate the cutting device 14.

Figure 3A:
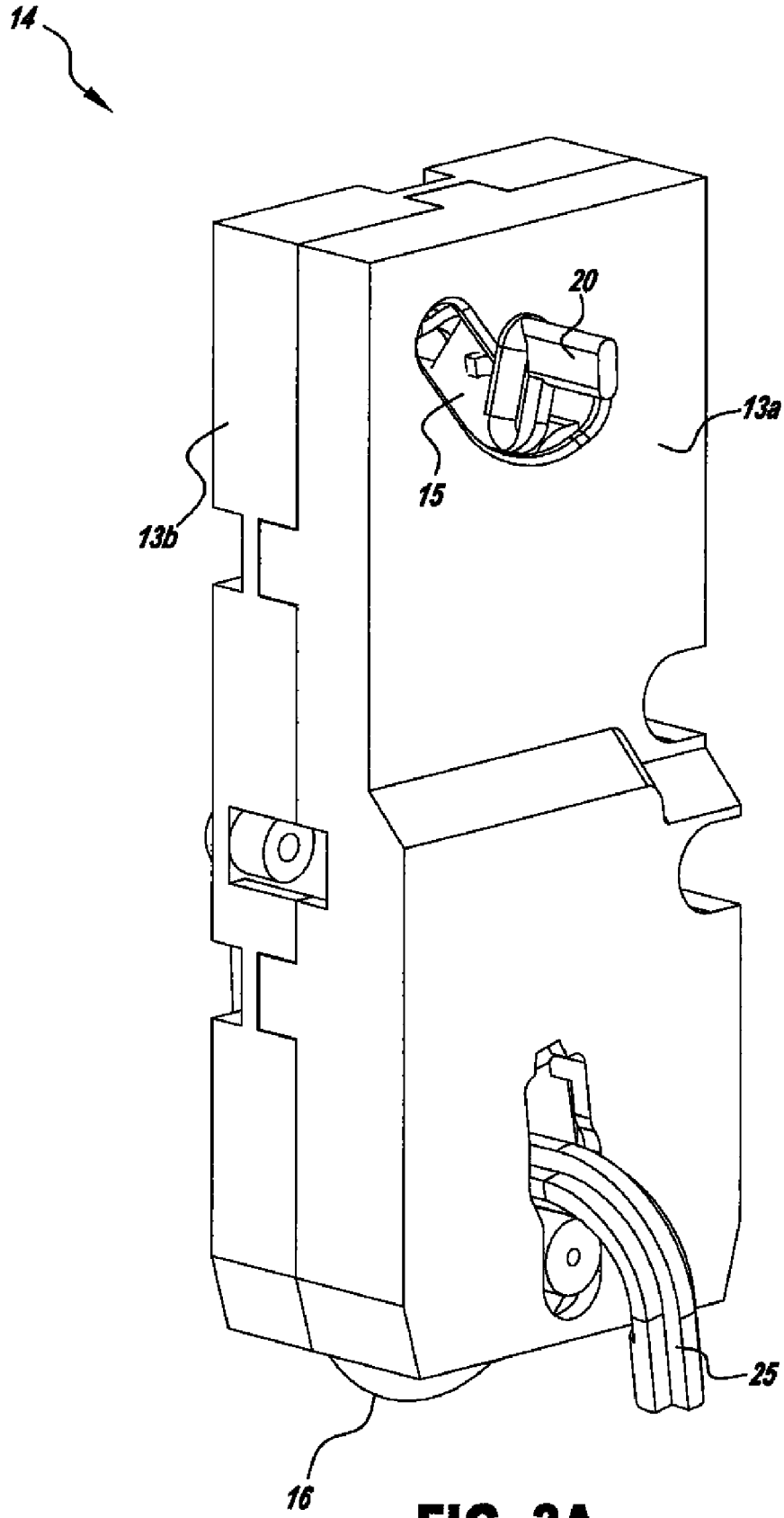
FIG. 3A is perspective view of a cutting device in the ink jet printer of FIG. 1 according to an aspect of embodiment of the invention.
Figure 3B:
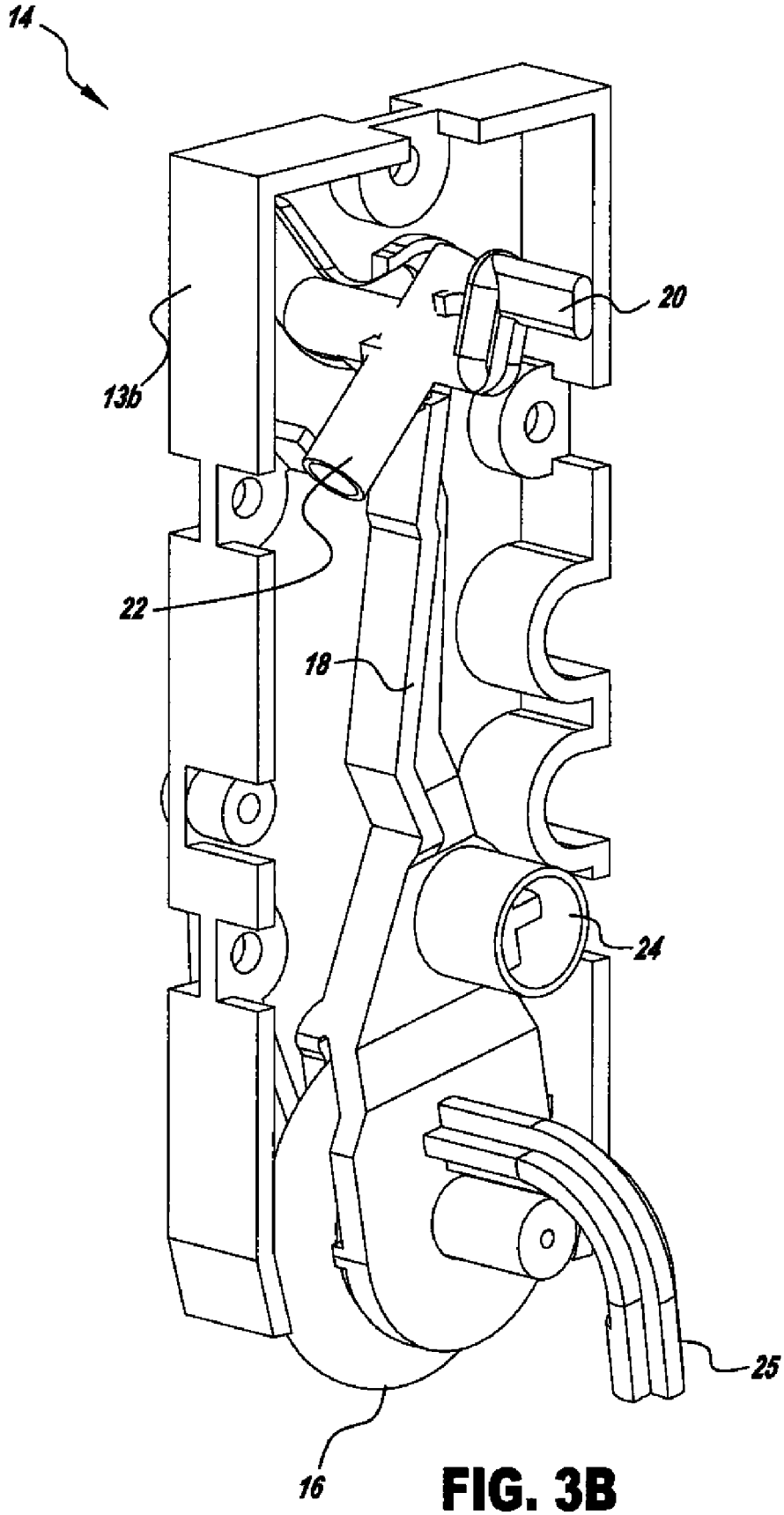
FIG. 3B is a perspective view of the inside of the cutting device of FIG. 3A.
Figure 4:
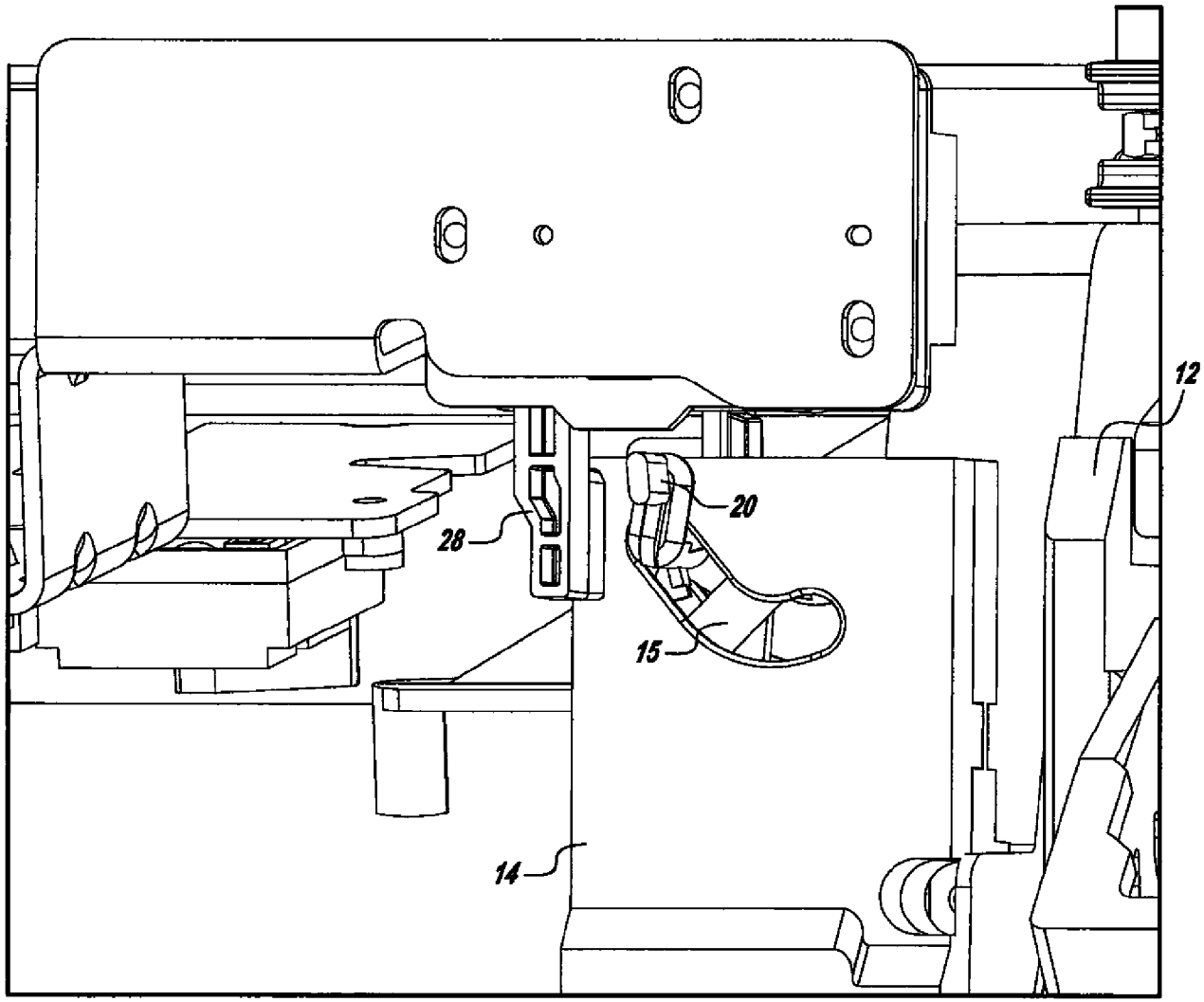
FIGS. 4-6 are perspective front views of the ink jet printer of FIG. 2 showing a portion of the printer carriage as a tab on the cutting device of FIG. 3A-B engages a cutter activator to activate a cutting wheel.
Figure 5:
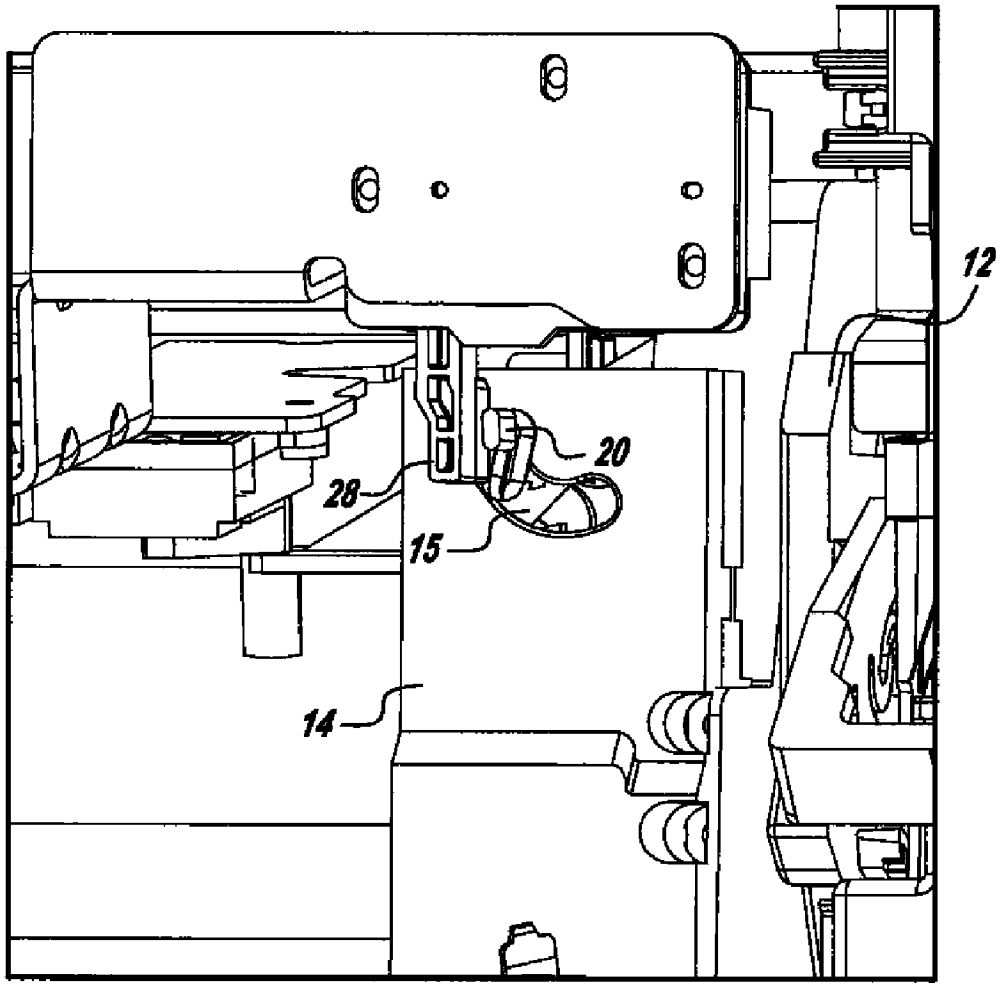
Figure 6:
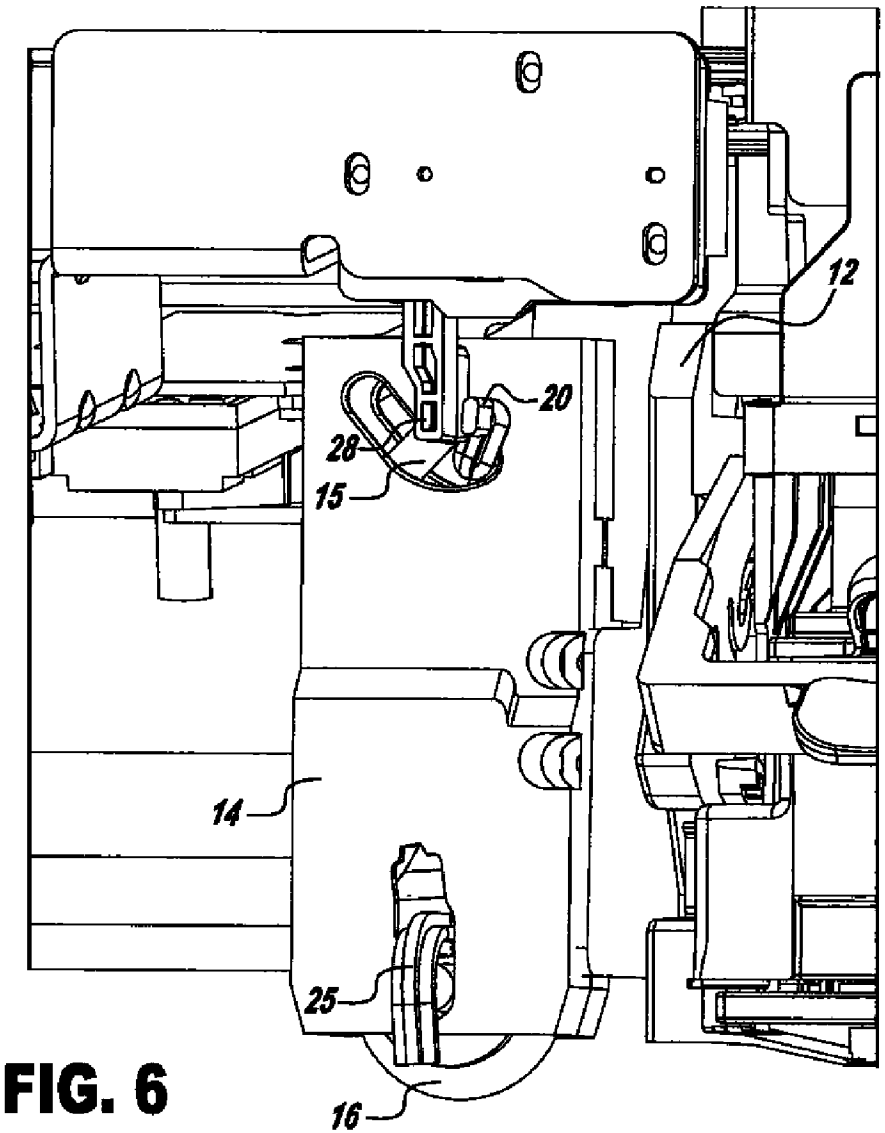

In the example shown in FIGS. 3A-3B, the cutting device 14 is formed of a front casing 13*a* and a rear casing 13*b* that enclose a cutting wheel 16 having an axle that is mounted on yoke 18. Yoke 18 has a tab 20 extending through slot 15 in front casing 13*a*. When tab 20 is moved to the upper portion of slot 15, cutting wheel 16 is withdrawn, and when tab 20 is moved to the lower position of slot 15, cutting wheel 16 is extended so that the cutting device 14 is activated. An upper spring 22 can be provided that enables the cutting wheel 16 to snap into position and a lower spring 24 can be provided that forces the cutting wheel 16 against the cutting bar (not shown) in the printer 10. Casing 13*a*, 13*b* can include a detent (for example at the lower horizontal or "down" portion of slot 15) that holds the yoke 18 in position until the tab 20 is moved to the other position. Yoke 18 can have an arm 25 that enables the cutting wheel 16 to be gently moved into engagement with the cutting bar, so that the cutting wheel 16 does not nick the cutting bar. As shown in FIG. 4-6, as the printer carriage 12 moves towards the left (in the view of FIG. 1) toward left housing 74, a cutter activator 28 attached to the printer framework engages tab 20 on cutting device 14 and continues to push tab 20 until the tab 20 moves into the down position of slot 15, pushing yoke 18 down to extend cutting wheel 16 so that cutting device 14 is activated. If the printer carriage 12 is now moved into the printing region where the media is located, the activated cutting device 14 cuts the media between the cutting wheel 16 and the cutting bar (not shown). The carriage 12 can proceed to the right housing 72 to park the printheads 82 in a maintenance station in a home position (not shown). As the carriage 12 moves toward the home position in right housing 72, a cutter deactivator (not shown) is engaged by tab 20 so that tab 20 is moved into the up position in inclined slot 15, thus raising cutting wheel 16 and deactivating the cutting device 14. For the next printing job, as carriage 12 exits the home position and moves into the printing region, the cutting device remains deactivated, so that printing can occur without simultaneously cutting the media. Occasionally it is desired to measure the color characteristics of a printed image. In an embodiment of the present invention, an optical measurement device such as a spectrophotometer is parked in a position at the far left side of left housing 74. The movement of the spectrophotometer is constrained to be along the same direction as the carriage motion, so that if the carriage and spectrophotometer are coupled together, the carriage can move the spectrophotometer back and forth across the printing region. The parked position of the spectrophotometer, far from the printing region, provides some protection against ink mist contamination of the optics of the spectrophotometer. In this configuration, cutter activator 28 is between the printing region and the spectrophotometer. An object of the present invention is to enable the printing carriage 12 to bypass cutter activator 28, couple with the spectrophotometer, and bring the spectrophotometer into the printing region for optical measurements, without having cutting device 14 activated in the printing region. Thus the media is not cut as the optical measurements are being made.

Figure 7:
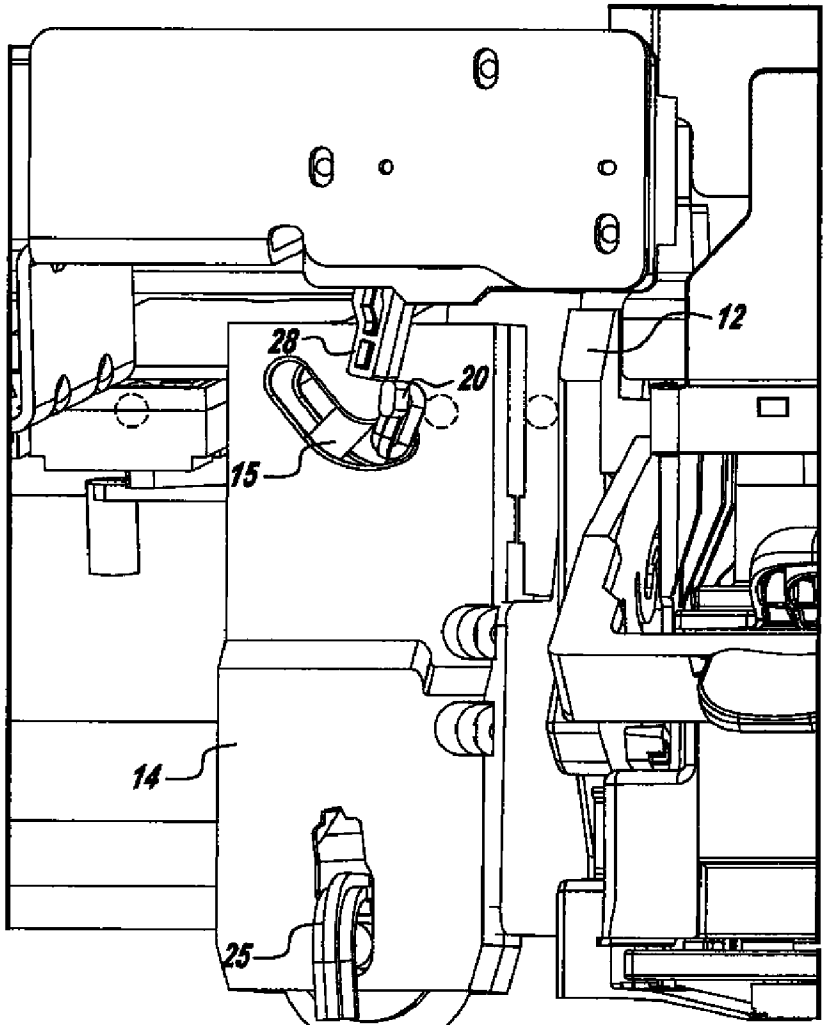
FIG. 7 is a perspective front view of the ink jet printer of FIG. 2 as a tab on the cutting device pushes the cutter activator out of the way.
Figure 8:
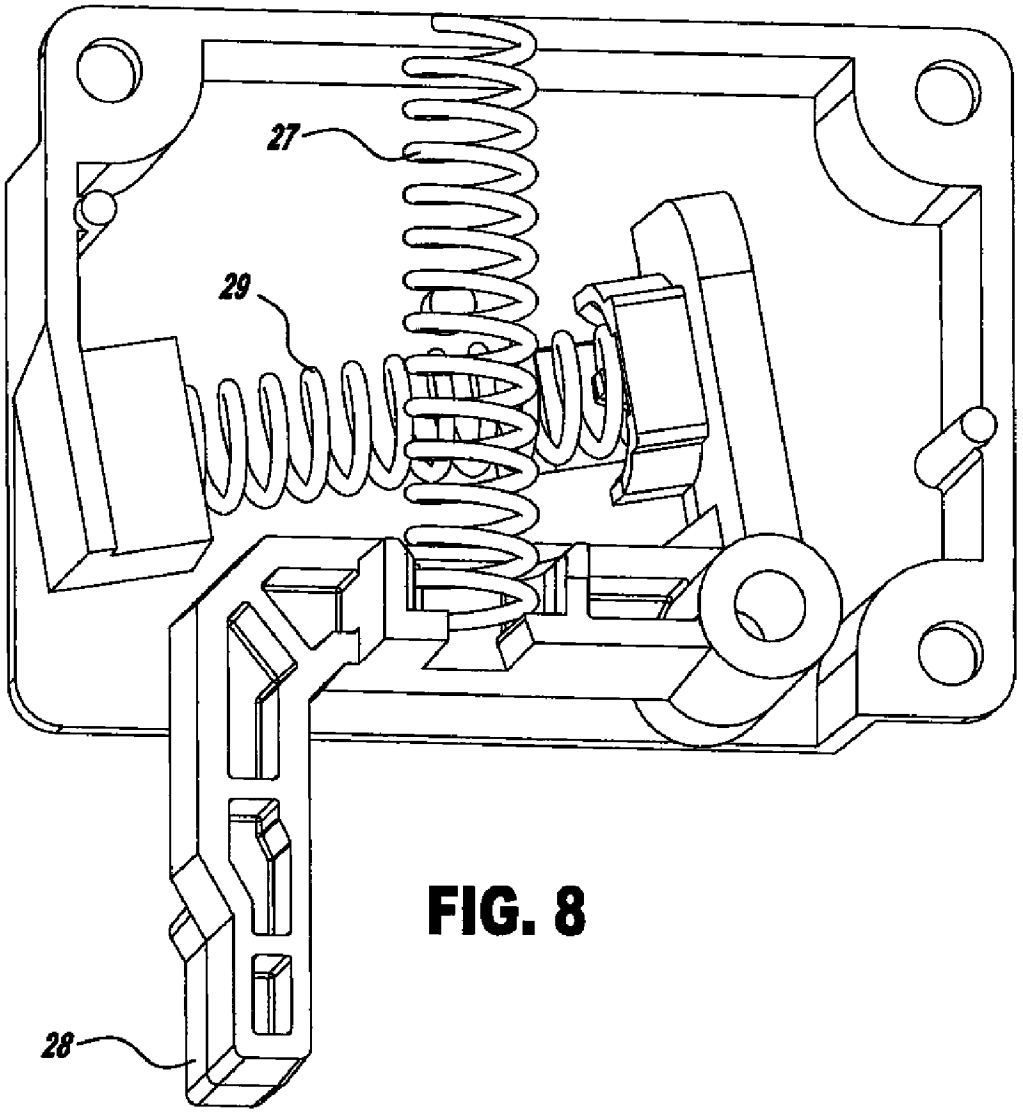
FIG. 8 is a perspective view of the inside of the casing of the cutter activator on the printer carriage.

As shown in FIG. 7, in order to couple with the optical measurement device, the printer carriage 12 continues moving to the opposite side of cutter activator 28. To do this, tab 20 pushes the cutter activator 28 up and out of the way. Specifically, the cutter activator 28 can have internal springs 27, 29, as shown in FIG. 8, that have an appropriate stiffness or strength (i.e., spring constant) so as to prevent the cutter activator 28 from being displaced when engaging the tab 20 to activate the cutting device 14. However, when tab 20 is at the end of travel in slot 15, as in FIG. 7, continued movement of printer carriage 12 (and consequently tab 20) to the left is able to overcome the stiffness of spring 27, so that cutter activator 28 can be pushed out of the way until it is bypassed by tab 20. It should be understood that when a cutter activator 28 is disposed in the printer 10, the printer carriage 12 may move past the cutter activator 28 to reach the optical measurement device, as explained above, however, the present invention is not limited to use in a printer that has a cutter activator.

Figure 9:
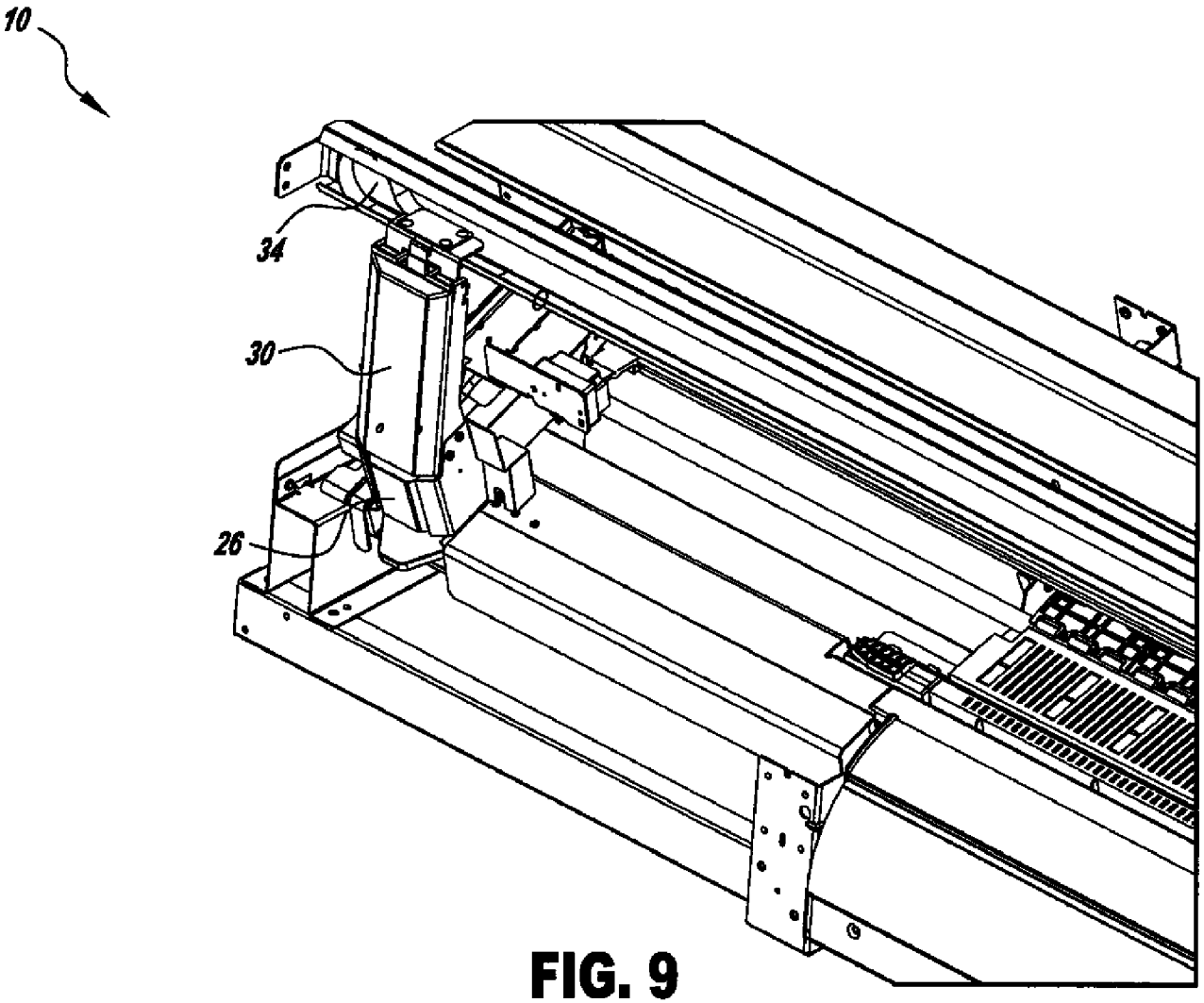
FIGS. 9-10 are perspective views of a spectrophotometer in the ink jet printer of FIG. 1 according to an aspect of an embodiment the invention.
Figure 10:
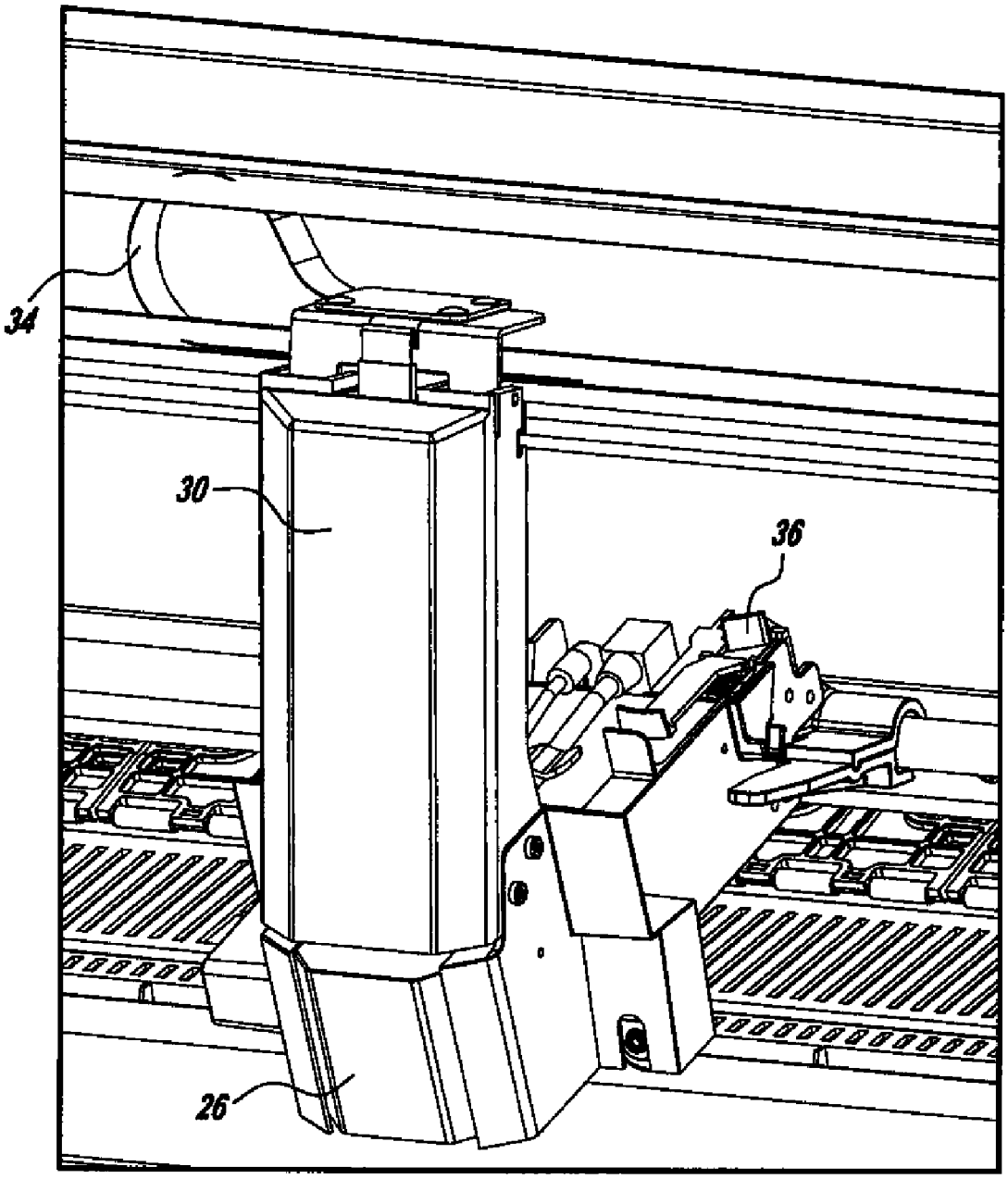
Figure 11:
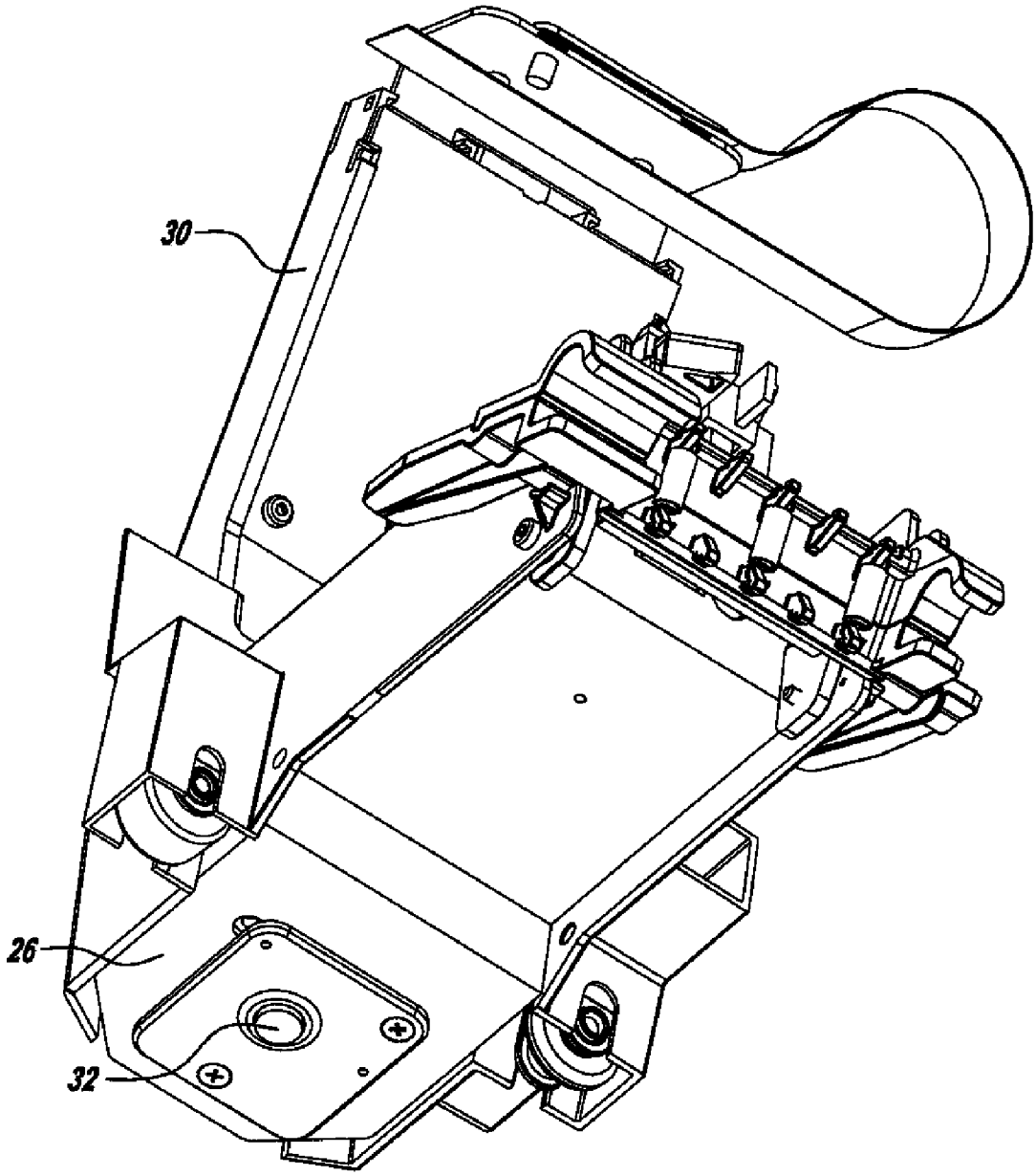
FIG. 11 is a perspective view of the underside of the spectrophotometer of FIGS. 8-9.

Once tab 20 has bypassed cutter activator 28, the printer carriage 12 is ready to be coupled with the optical measurement device, such as the spectrophotometer 26 shown in FIGS. 9-11. A bracket 30 slidably connects the spectrophotometer 26 to the printer 10 frame. A latch 36 attached to the bracket 30 is used to connect the spectrophotometer 26 to the printer carriage 12 as described below. The underside of the spectrophotometer 26 includes a sensor assembly 32 (including a light emitter, a sensor and associated optics) that is used to measure color. A cable 34 communicates data from the spectrophotometer 26 to the printer controller.

Figure 12:
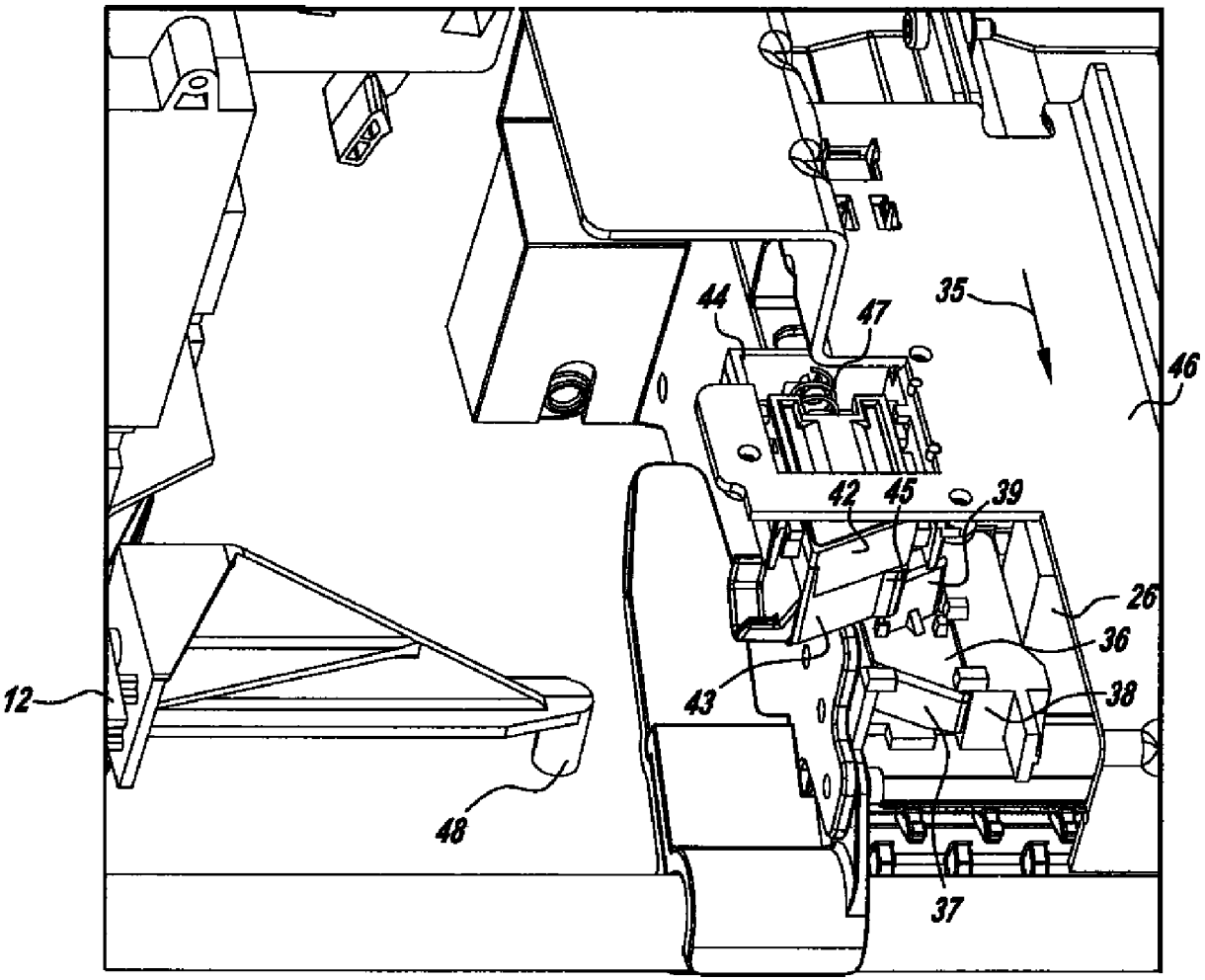
FIG. 12 is a perspective rear view of the ink jet printer of FIG. 1 as the printer carriage approaches the spectrophotometer.
Figure 13:
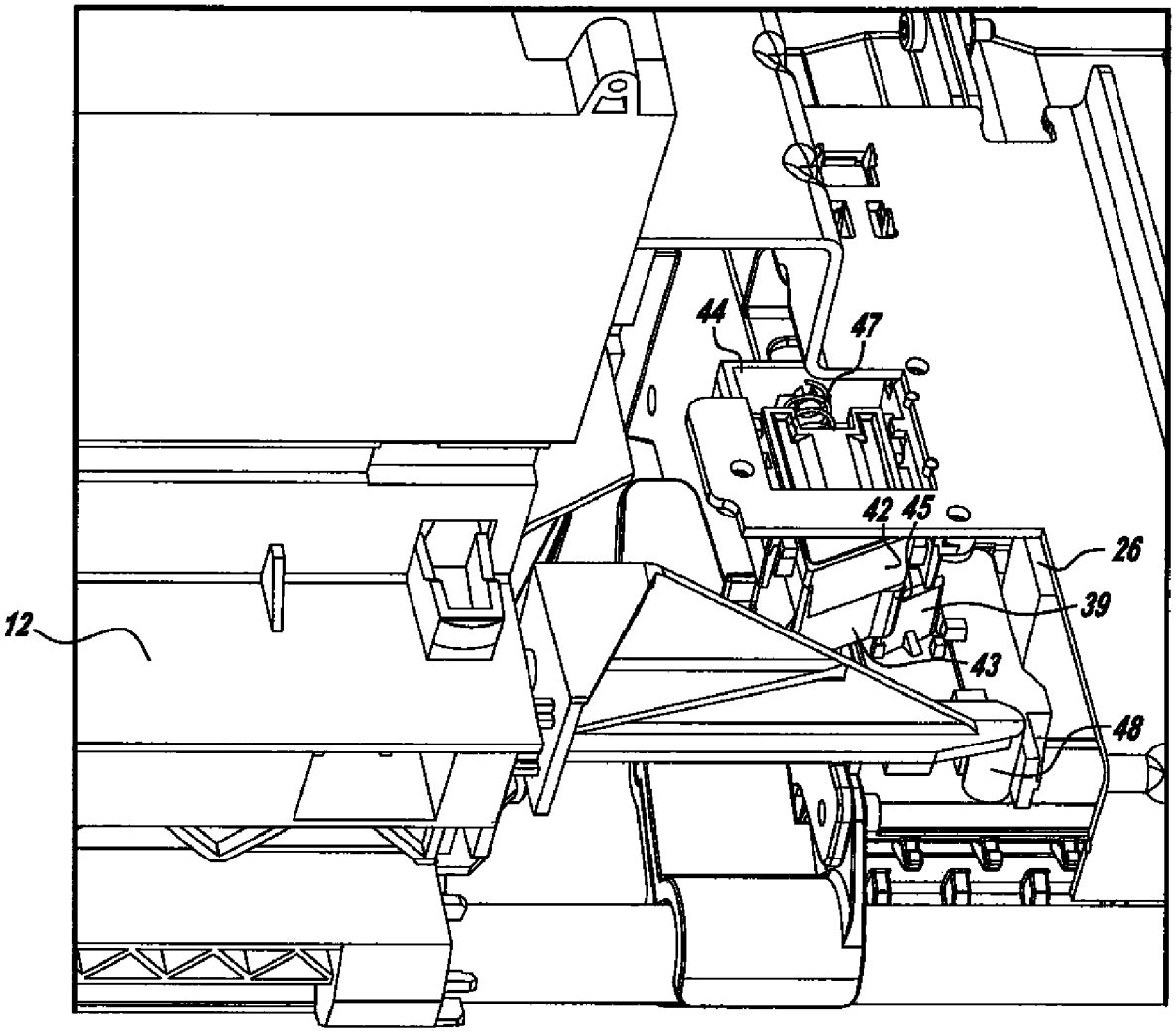
FIG. 13 is a perspective rear view of the ink jet printer of FIG. 1 as the printer carriage hook contacts the spectrophotometer.

Referring now to the rear view shown in FIG. 12, when the spectrophotometer 26 is in its parked position, the latch 36 is retracted within latch housing 38, and is held in the retracted state by latch retractor 42. Latch 36 includes a latching portion 37 and an inclined contact portion 39 having a rear edge 41 (shown in FIG. 14). Latch retractor 42 includes an inclined contact portion 43 and a catch 45, and is mounted on an latch retractor housing 44 that is attached to the printer frame with a bracket 46. Spring 47 that is disposed in the latch retractor housing 44 pushes on the latch retractor 42 in a rearward direction 35, while also allowing the latch retractor 42 to be pushed in an opposite direction as described below. In the views of FIGS. 12 and 13, the catch 45 of latch retractor 42 is holding rear edge 41 of inclined contact portion 39 so that latch 36 is held in the retracted position.

Figure 14:
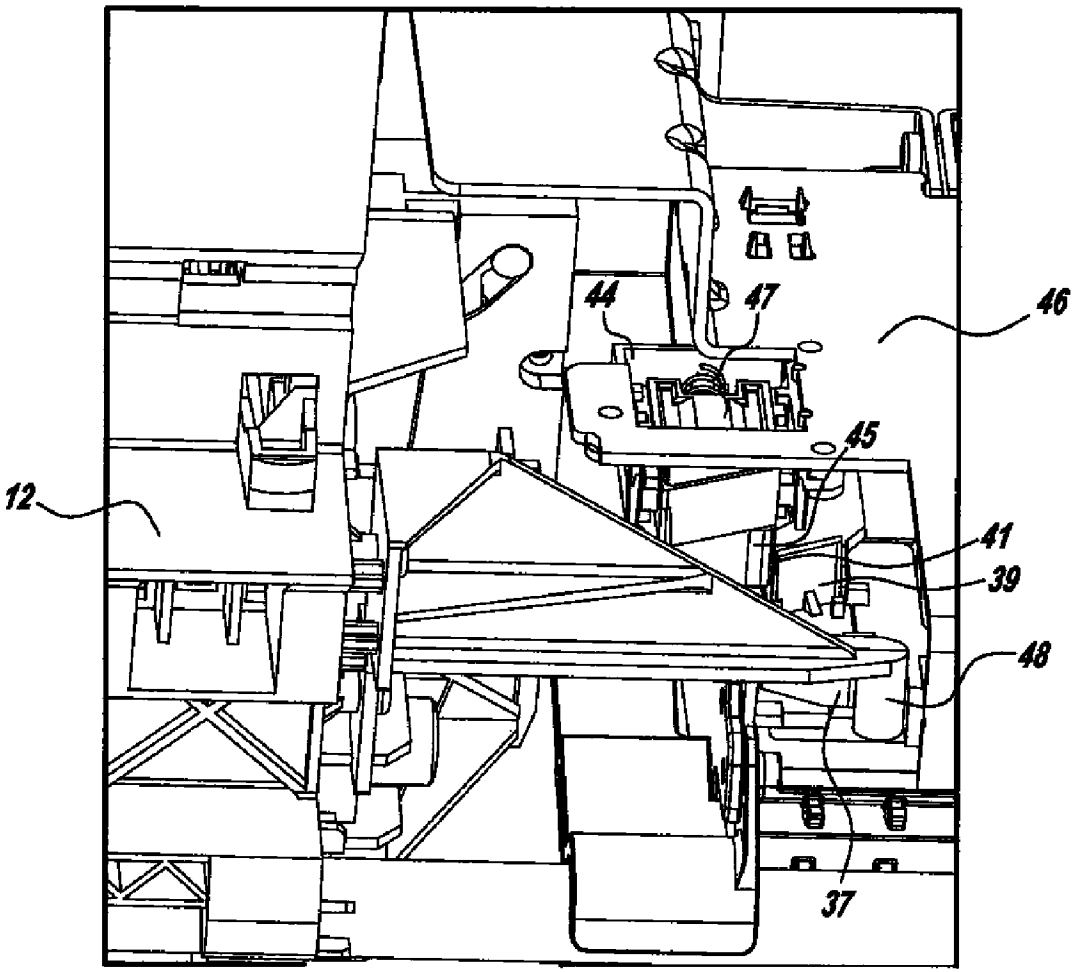
FIG. 14 is a perspective rear view of the ink jet printer of FIG. 1 as a printer carriage hook pushes the spectrophotometer.
Figure 15:
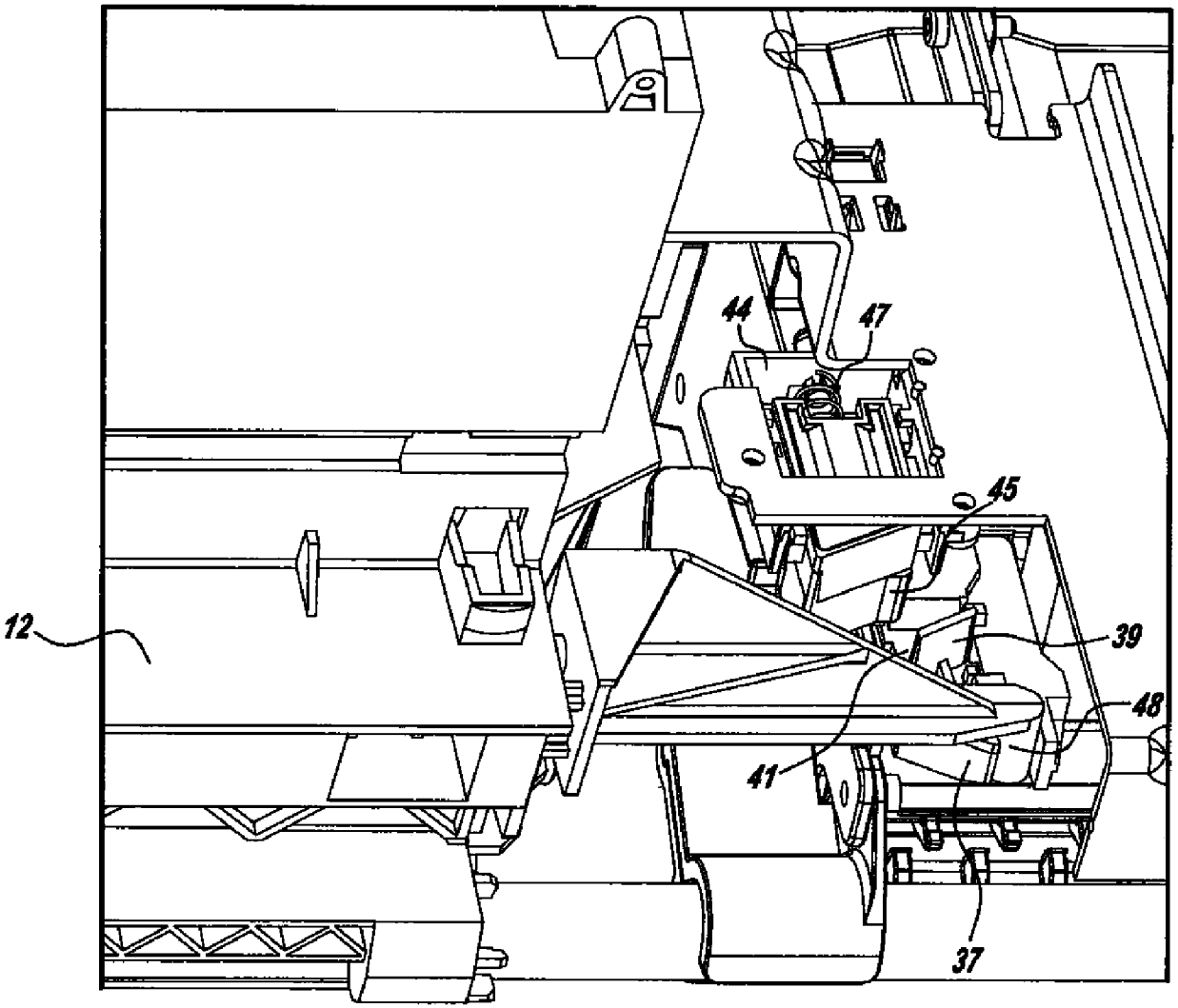
FIG. 15 is a perspective rear view of the ink jet printer of FIG. 1 as a latch closes to couple the spectrophotometer to the printer carriage.
Figure 16:
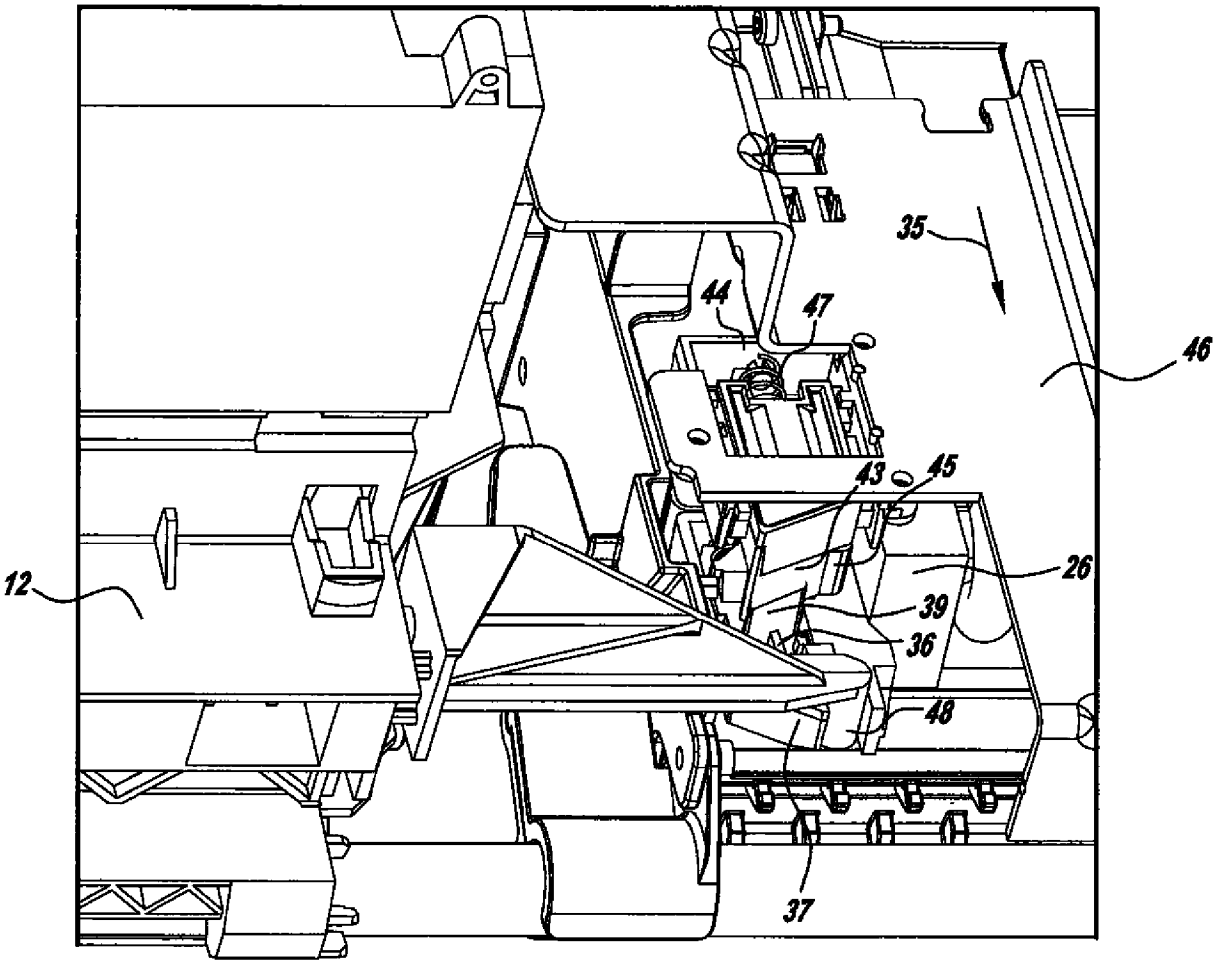
FIGS. 16-18 are perspective rear views of the ink jet printer of FIG. 1 as the printer carriage pulls the spectrophotometer away from its parked position.
Figure 17:
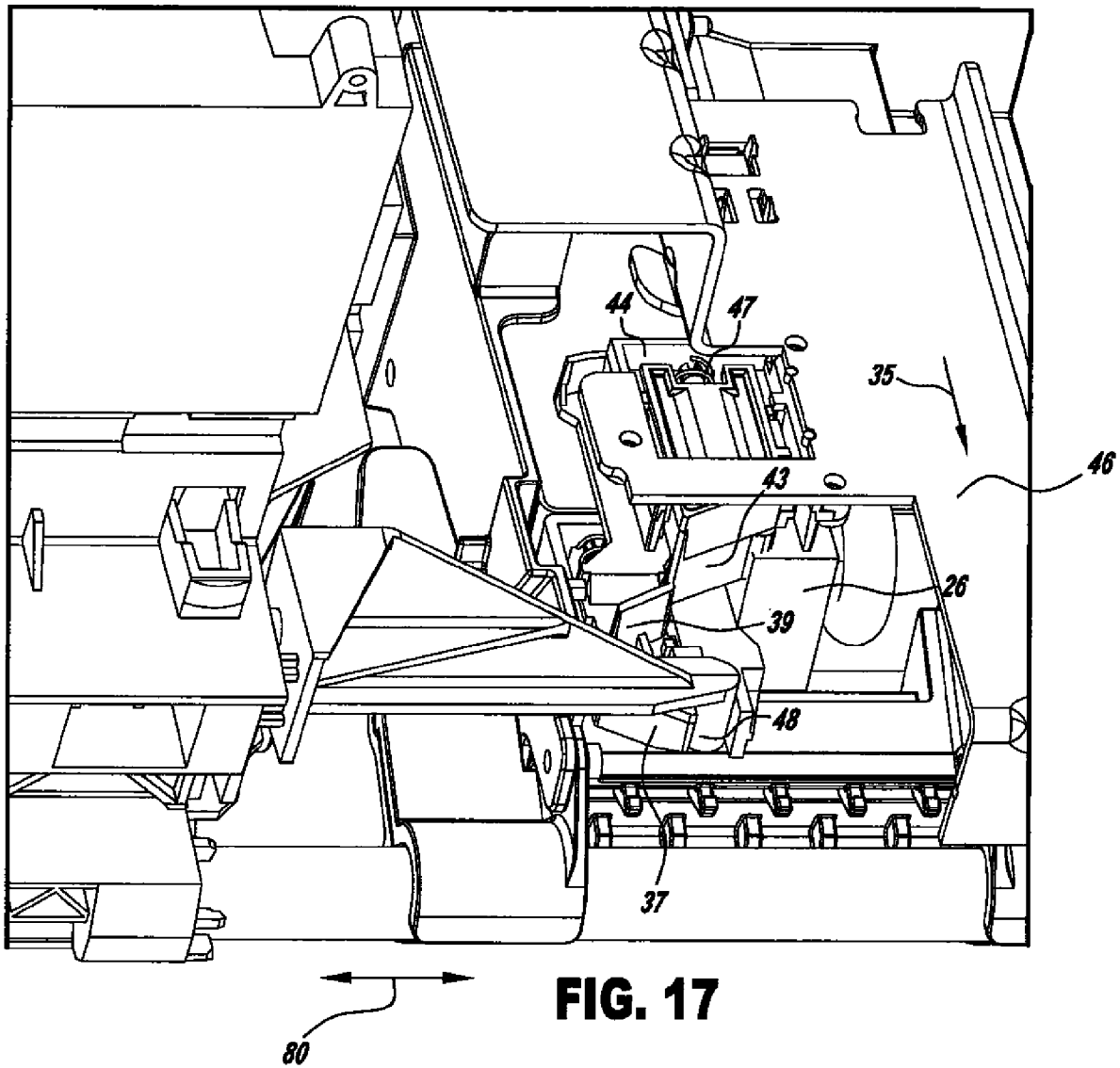
Figure 18:
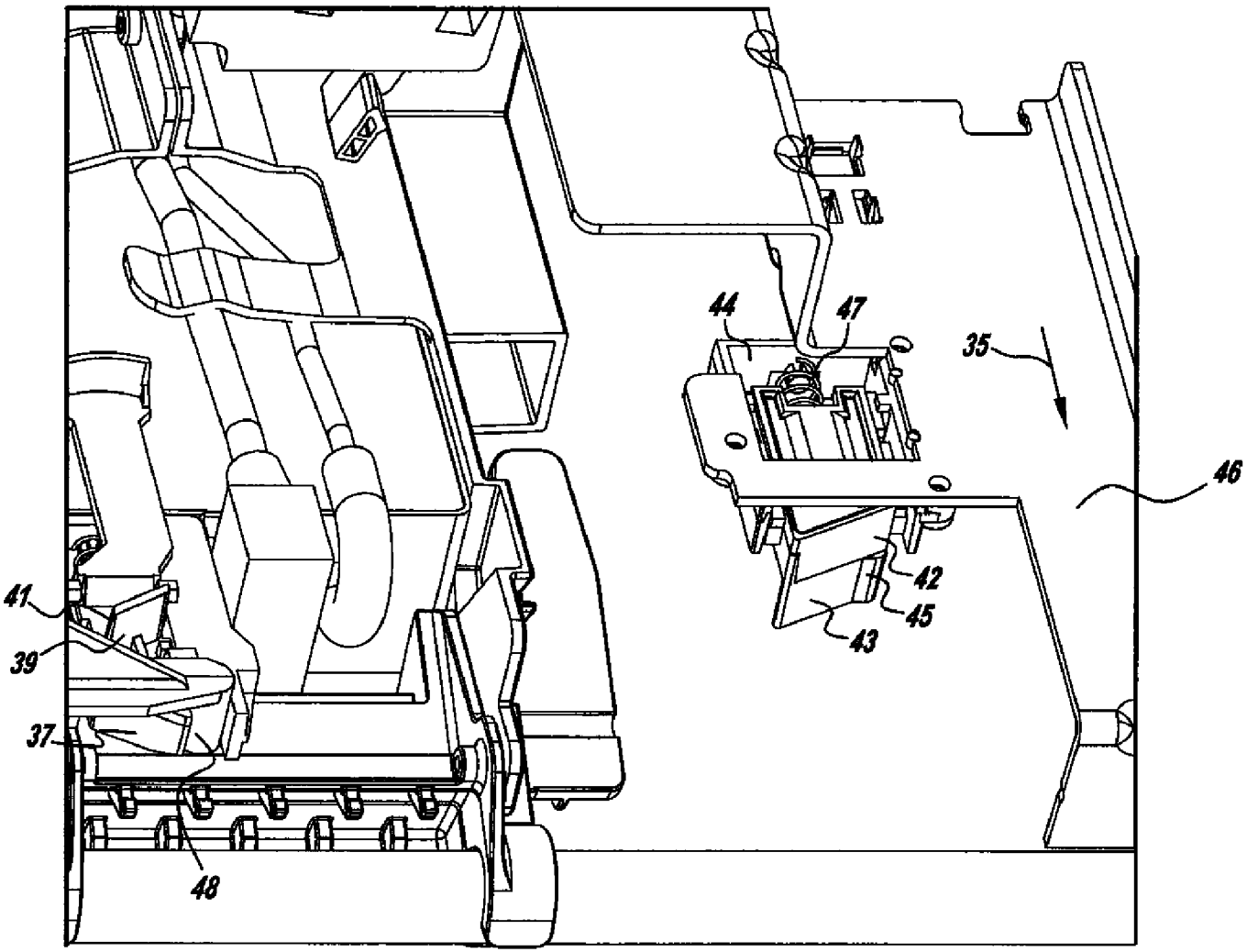

When the printer carriage 12 approaches the spectrophotometer 26, a printer carriage hook 48 extending from the printer carriage 12 pushes against the spectrophotometer 26 further toward the left side of housing 74 in the front view of FIG. 1, or toward the right as shown in the rear view of FIG. 13. As the printer carriage hook 48 pushes the spectrophotometer 26 away from its parked position, the rear edge 41 of inclined contact portion 39 of latch 36 is pushed away from the catch 45 of the latch retractor 42, as shown in FIG. 14. A spring (not shown) in the latch 36 then snaps the latch 36 into an unretracted position, so that the latching portion 37 captures hook 48 as shown in FIG. 15. A stopper (not shown) may be provided to prevent the latch 36 from extending too far. As the printer carriage 12 is then moved in the opposite direction toward the printing region, the printer carriage hook 48 then pulls the spectrophotometer 26 towards the printing region and the inclined contact portion 39 of latch 36 engages the inclined contact portion 43 of latch retractor 42, as shown in FIG. 16. The purpose of the inclined contact portions 39 and 43 is to provide a motion in a direction perpendicular to carriage direction motion 80. As the printer carriage hook 48 continues to pull the spectrophotometer 26 towards the printing region, the inclined contact portion 39 of latch 36 pushes the inclined contact portion 43 of latch retractor 42, so that the latch retractor 42 slides up in a direction opposite rearward direction 35 and out of the way, as shown in FIG. 17. Assisted by spring 47 in the latch retractor housing 44, the latch retractor 42 then snaps along rearward direction 35 into its normal position, as shown in FIG. 18.

Figure 19:
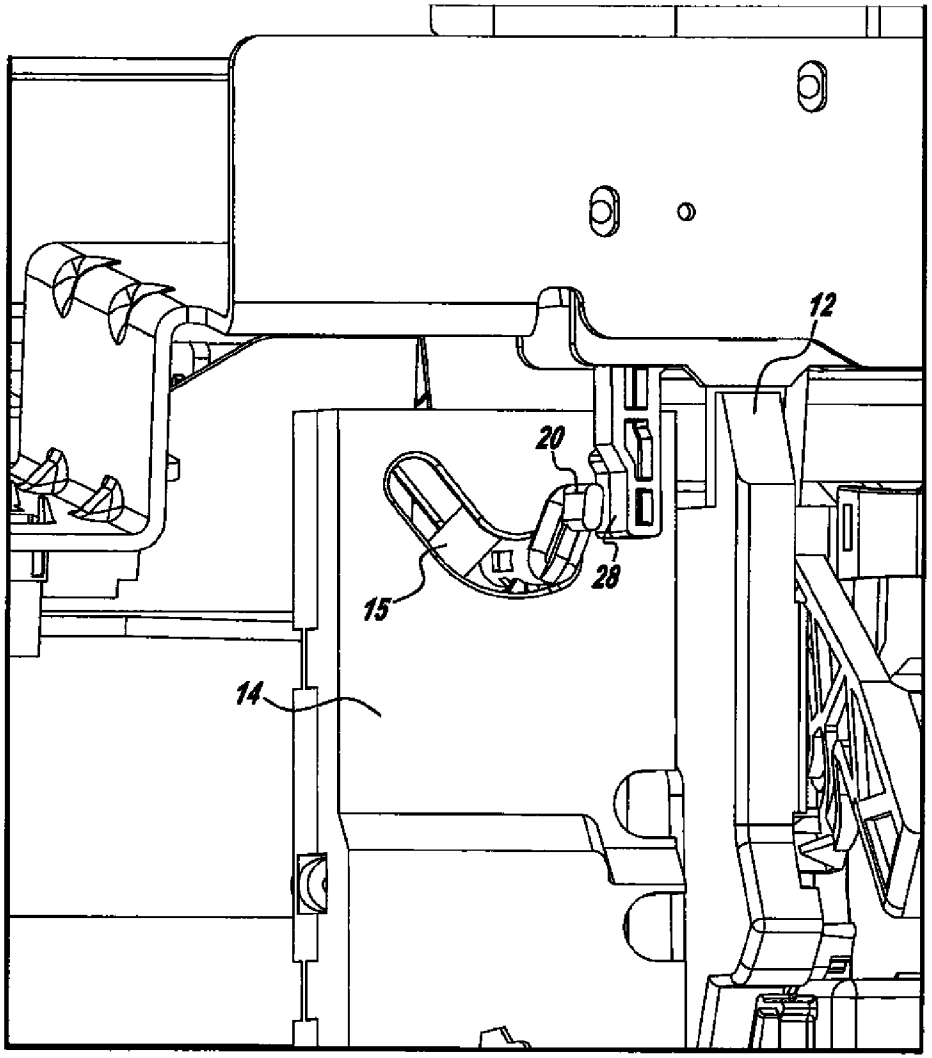
FIG. 19-21 are perspective front views of the ink jet printer of FIG. 1 as the printer carriage moves toward the printing region after coupling with the spectrophotometer.
Figure 20:
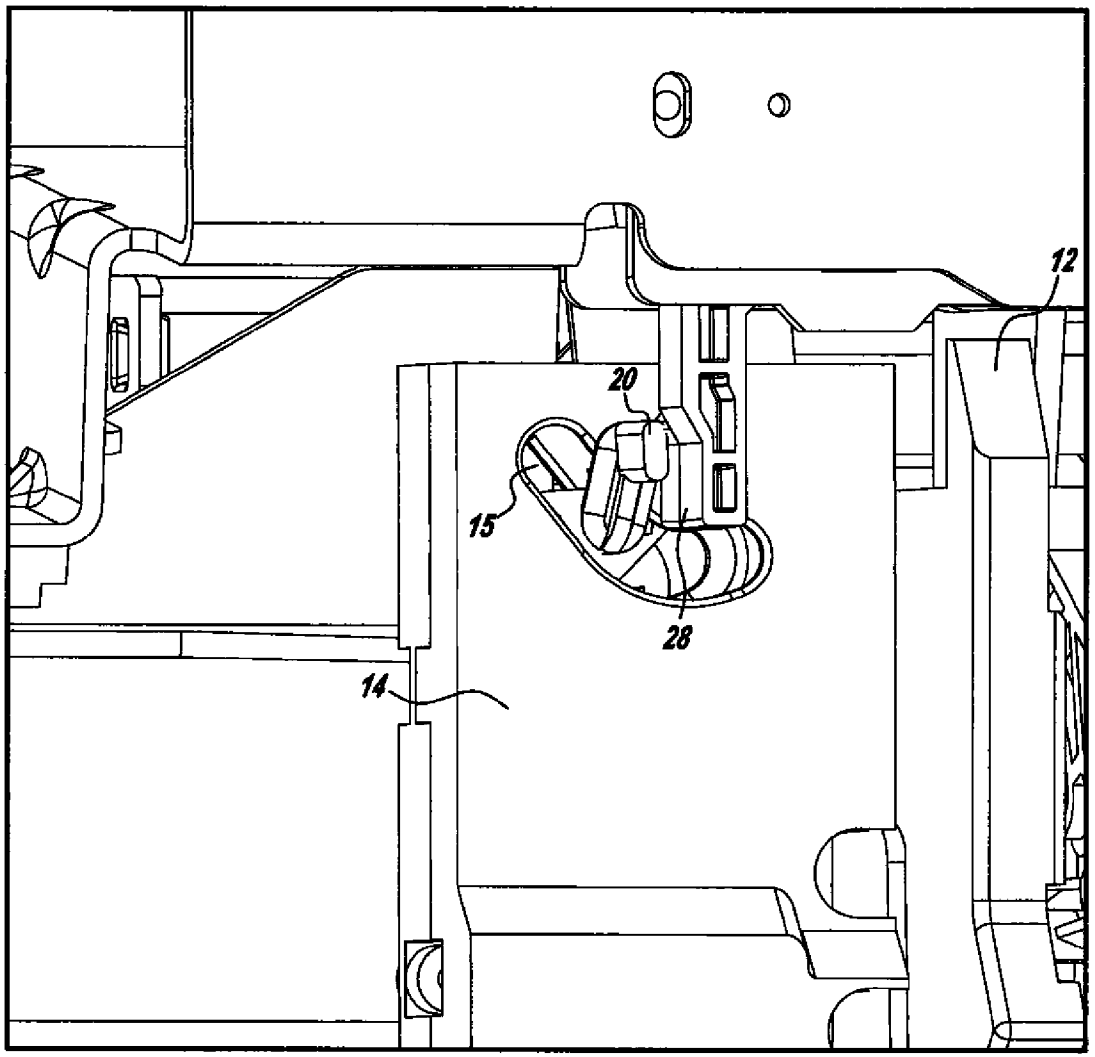
Figure 21:
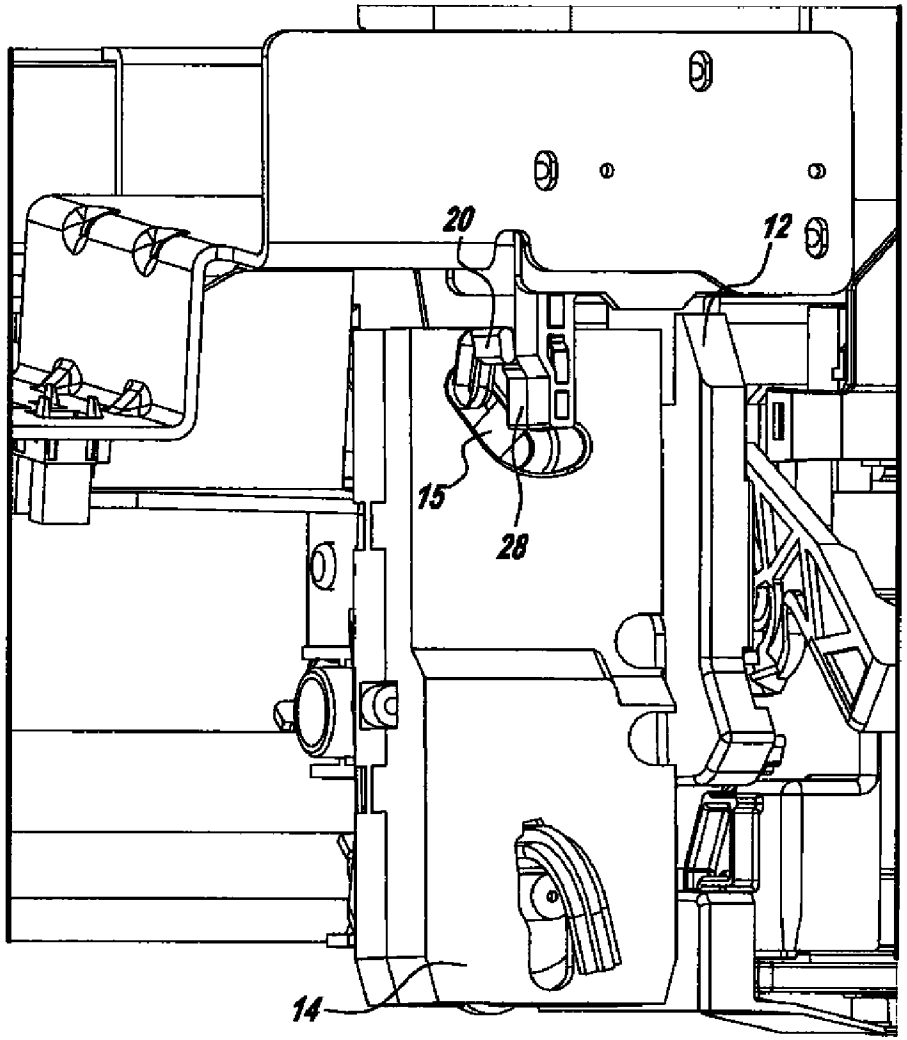
Figure 22:
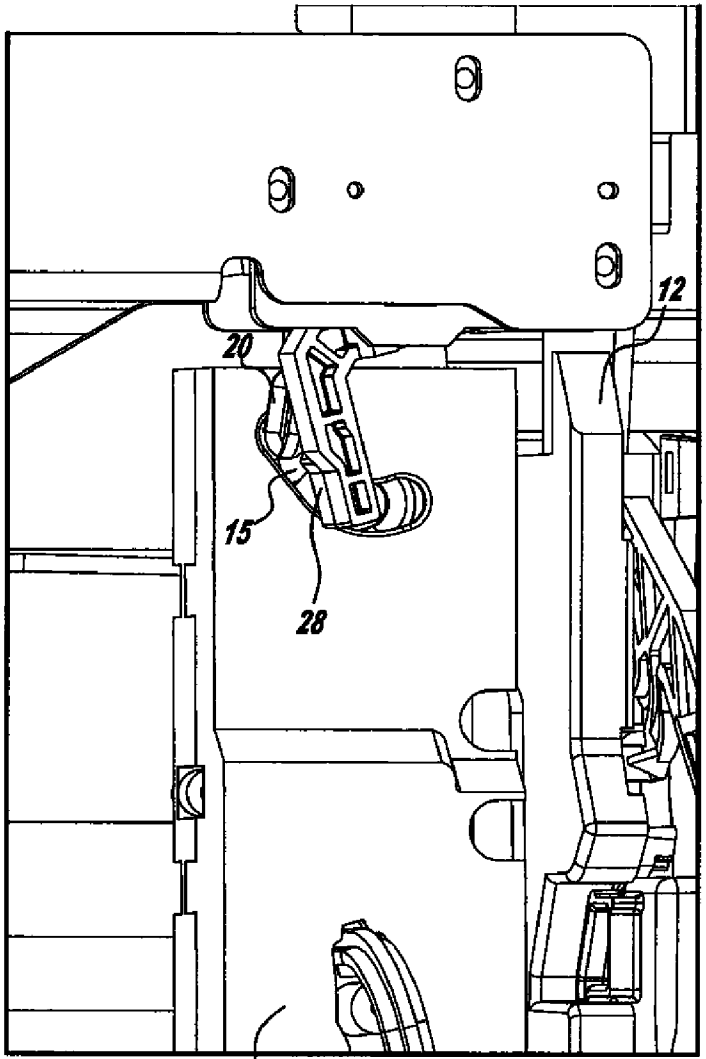
FIG. 22 is a perspective view of the printer carriage bypassing the cutter activator after the printer carriage couples with the spectrophotometer.

At this point, the cutting wheel 16 is still extended and must be raised before the printhead carriage 12 and the spectrophotometer 26 connected to it move into the printing region for making optical measurements. As shown in FIG. 19, as the printer carriage 12 moves towards the printing region, tab 20 engages the back-side of the cutter activator 28. As a result, tab 20 is moved up along inclined slot 15 to deactivate the cutting wheel 16, as shown in FIGS. 20-21. When the tab 20 has reached the end of slot 15, it can move no further, so as the printer carriage 12 continues to move toward the printing region, spring 29 is compressed (FIG. 8) and cutter activator 28 is moved aside so that tab 20 can bypass it, as shown in FIG. 22.

Figure 23:
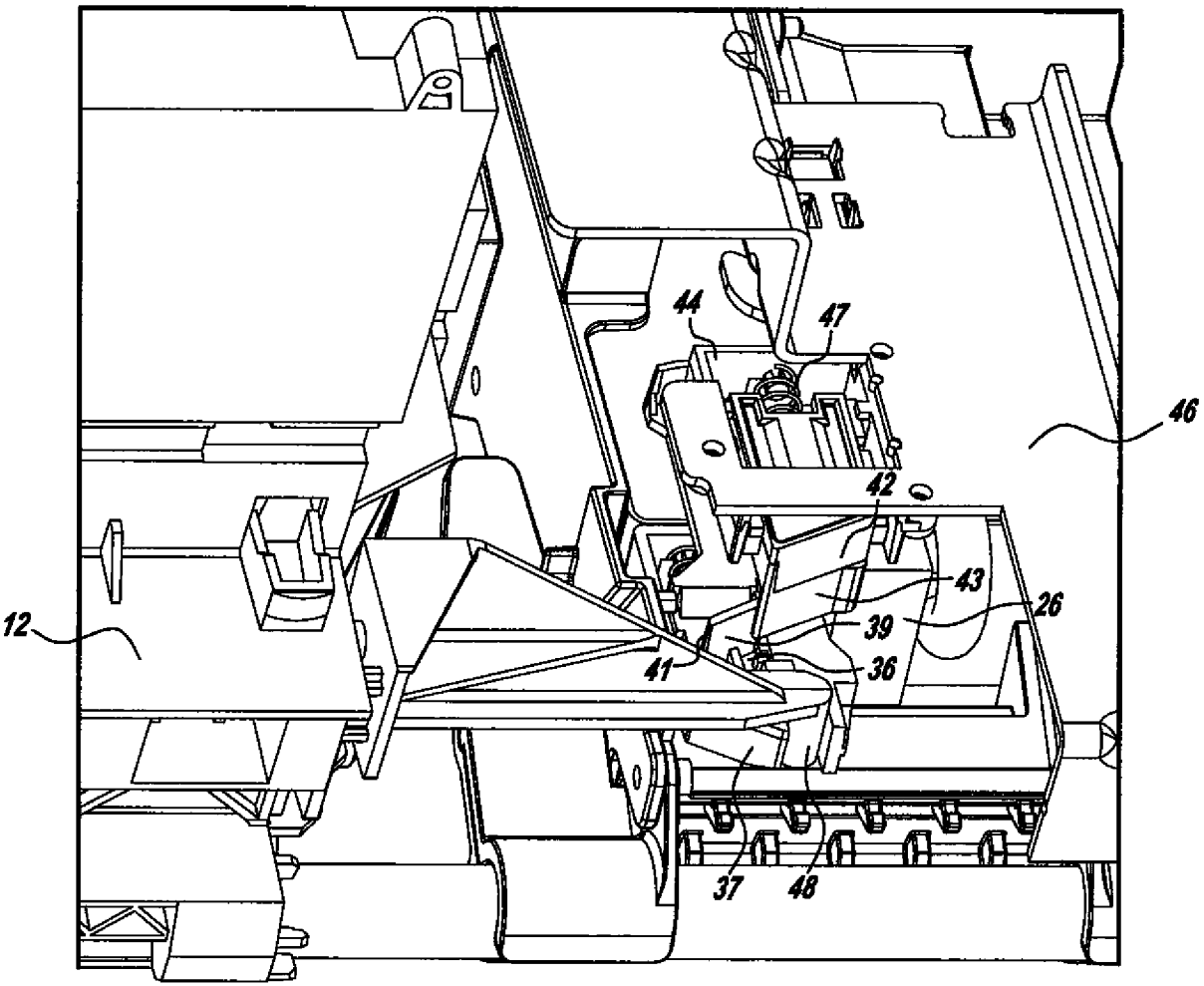
FIG. 23-25 are perspective rear views of the ink jet printer of FIG. 1 as the printer carriage returns the spectrophotometer to its parked position.
Figure 24:
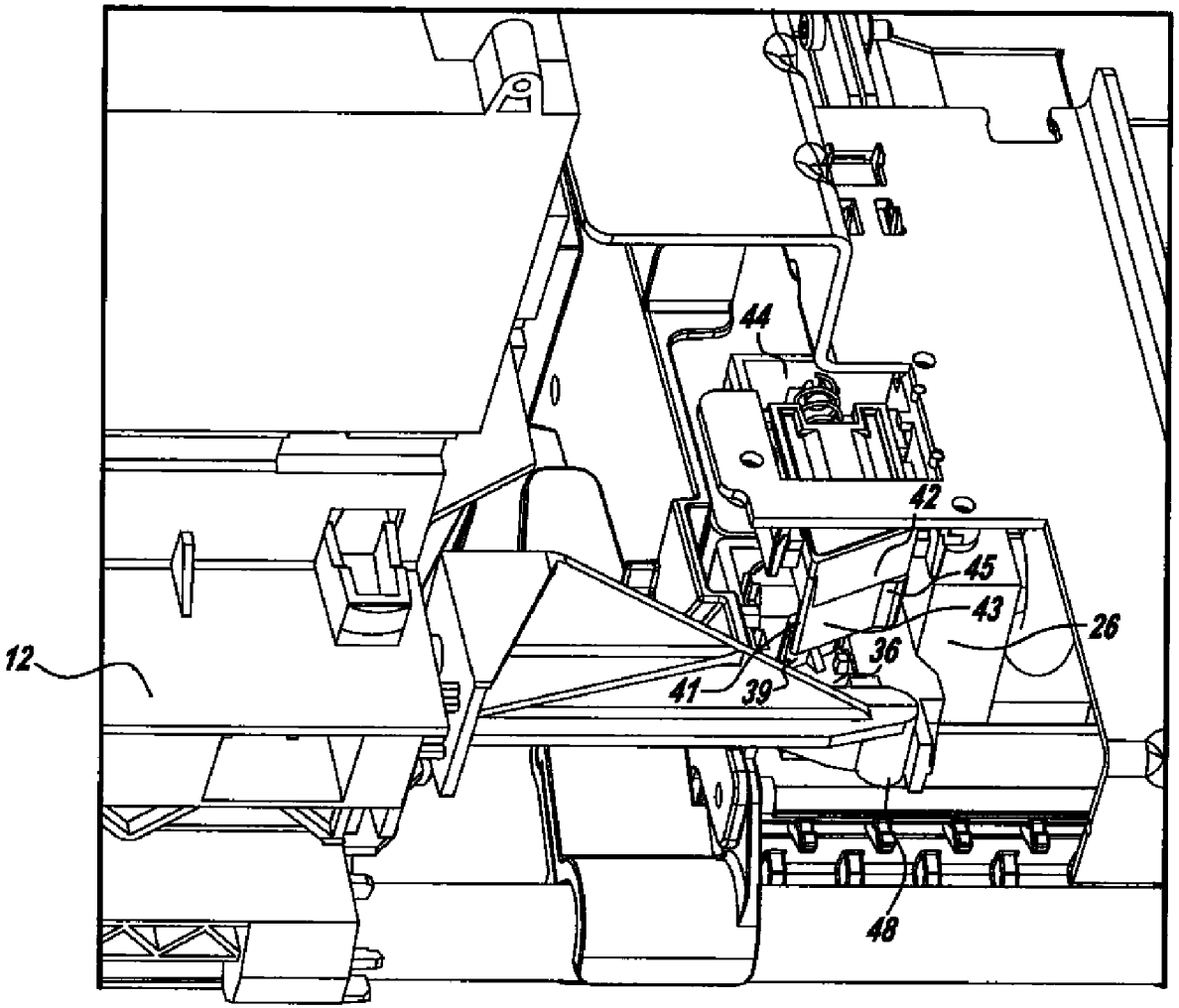
Figure 25:
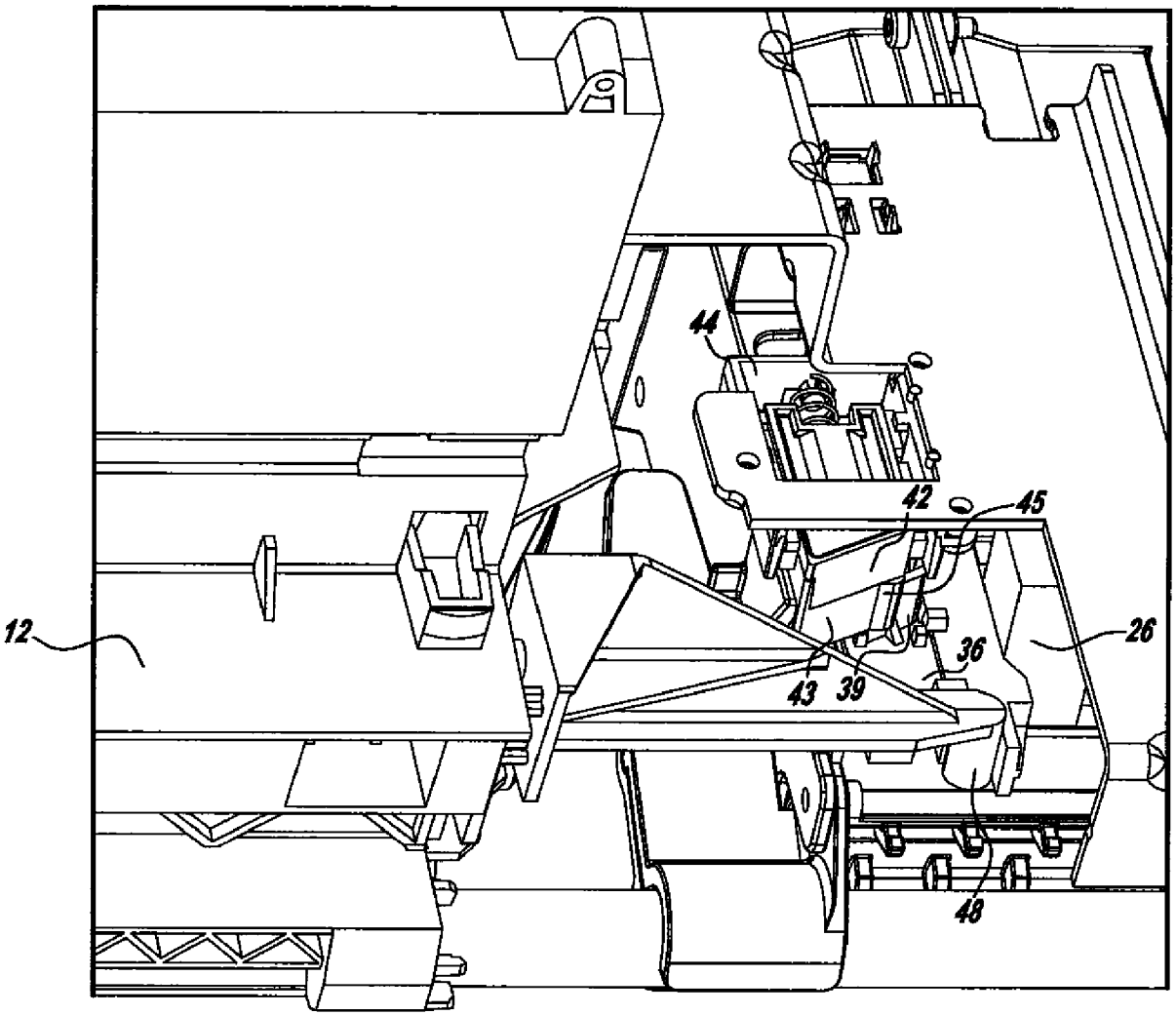

When the spectrophotometer 26 is coupled to the printer carriage 12, as described above, the spectrophotometer 26 may move from side-to-side along direction 80 in the printer together with the printer carriage 12 and perform its optical measurements. When the optical measurement device completes its measurements, the printer carriage 12 may return the optical measurement device to its parked position. Specifically, the printer carriage hook 48 on the printer carriage 12 pushes the spectrophotometer 26 back to the left housing 74 of printer 10 until the latch 36 engages the latch retractor 42, as shown in FIG. 23. The latch 36 then begins to retract as the inclined contact portion 39 of the latch 36 slides along the inclined contact portion 43 of the latch retractor 42, as shown in FIGS. 23 and 24. Comparing FIG. 23 with FIG. 17, note that in the latch retracting step corresponding to FIG. 23, opposite surfaces of inclined contact portions 39 and 43 are in contact relative to the latch engaging step corresponding to FIG. 17. The printer carriage hook 48 continues pushing the spectrophotometer 26 until the rear edge 41 of the inclined contact portion 39 of latch 36 is held back in the retracted position by catch 45 of the latch retractor 42, as shown in FIGS. 23-25. The printer carriage 12 is then free to move back to the printing region of the printer 10 so it can resume its printing operations. During the approach of the printer carriage 12 toward uncoupling the spectrophotometer, the cutting device 14 was again activated, but as the printer carriage moved back toward the printing region, the cutting device is again deactivated as described above in relation to the coupling of the spectrophotometer 26 to the printer carriage 12.

The cutting device 14 is a kind of tool having an activated state (e.g. blade in the cutting position) and a deactivated state (e.g. withdrawn blade) and can be a cutter, such as a blade, a perforator, or a cutting wheel. Alternatively, the cutting device 14 may be replaced by other kinds of devices having a mechanically activated state and a deactivated state, such as a light shutter.

The cutter activator 28 is a kind of intervening mechanism that activates and/or deactivates the tool and is disposed in the path between the printing region and the parked position of the device that may be selectively connectable to the printer carriage 12.

The spectrophotometer 26 is a kind of device to which the printer carriage 12 may be selectively connected to or disconnected from. In place of the spectrophotometer 26 as the device, the following examples may serve as exemplary selectively connectable devices: a spectrometer, a photometer, a densitometer, an image scanner a heater, a Hall effect sensor, and an ultraviolet light source.

The printer carriage 12 is a type of carriage and may include an inkjet print head.

It is understood that the present invention is not limited to the printer carriage being coupled with a particular type of device, such as a spectrophotometer. Rather, the printer carriage can be coupled with any type device having a latch and latch retractor as explained above.

It is further understood that the above-described embodiments are merely illustrative of the possible specific embodiments which may represent principles of the present invention. Other arrangements may be readily devised in accordance with these principles by those skilled in the art without departing from the scope of the invention.

PARTS LIST

10 printer
12 printer carriage
13 cutting device casing
14 cutting device
15 slot
16 cutting wheel
18 yoke
20 tab
22 upper spring
24 lower spring
25 arm
26 spectrophotometer
27 spring
28 cutter activator
29 spring
30 bracket
32 sensor assembly
34 cable
35 rearward direction
36 latch
37 latching portion
38 latch housing
39 inclined contact portion of latch
41 rear edge of inclined contact portion of latch
42 latch retractor
43 inclined contact portion of latch retractor
44 latch retractor housing
45 latch retractor catch
46 bracket
47 spring
48 printer carriage hook
70 guide rail
72 right housing
74 left housing
76 legs
78 platen
80 bidirectional arrow
82 printhead
84 tubing
86 ink reservoirs

The invention claimed is:

1. A printing apparatus comprising:

a printer carriage;

a device, the printer carriage being configured to selectively retrieve the device from and return the device to a position where the device can be parked detached from the printer carriage, the printer carriage being arranged to selectively move back and forth relative to the device while the device is detached from the printer carriage and in unison with the device while the device is attached to the printer carriage;

a tool mounted to the printer carriage, the tool including an activated state and a deactivated state; and an intervening mechanism that activates and deactivates the tool, the printer carriage and the intervening mechanism having respective surfaces that engage as they meet each other to allow the printer carriage to move past the intervening mechanism.

2. The apparatus of claim 1, wherein the tool includes one of a cutter, a blade, a cutting wheel, a perforator, and a light shutter.

3. The apparatus of claim 1, wherein the device is one of a spectrometer, a spectrophotometer, a photometer, a densitometer, an image scanner, and an ultraviolet light source.

4. The apparatus of claim 1, wherein the printer carriage and the device are equipped with a latch and a hook that are arranged to engage each other to attach the carriage and device together and to detach from each other.

5. The apparatus of claim 1, the device being an optical measurement device, the printer carriage including one of a hook and a latch, the optical measurement device including the other of a hook and a latch, the hook being configured to connect with the latch to couple the optical measurement device to the printer carriage; the optical measurement device being configured to move with the printer carriage when the optical measurement device is coupled to the printer carriage, the hook being configured to disconnect from the latch to return the optical measurement device to a parking position.

6. The apparatus of claim 5 further comprising a printer frame having a latch retractor configured to retract the latch.

7. The apparatus of claim 6, the latch including a first inclined surface and the latch retractor including a second inclined surface, wherein the first inclined surface and the second inclined surface are configured to slide along each other.

8. The apparatus of claim 6, wherein the latch is held in a retracted state by the latch retractor when the optical measurement device is in a parking position, and the printer carriage is arranged to couple with the optical measurement device as the hook engages the latch such that the latch is released from the latch retractor and extends to an unretracted state to connect with the hook.

9. The apparatus of claim 8 wherein when the printer carriage returns the optical measurement device to a parking position:

the hook facilitates engagement of the latch with the latch retractor such that the latch returns to a retracted state that is held by the latch retractor; and the hook is disconnected from the latch such that the printer carriage is able to move within the printer without being coupled to the optical measurement device.

10. The apparatus of claim 5 wherein the optical measurement device is a spectrophotometer.

11. The apparatus of claim 5, the intervening mechanism including a cutter activator, wherein the tool comprises a cutting device including a tab that activates a cutting wheel, wherein as the printer carriage moves towards the cutter activator, the cutter activator engages a first side of the tab to activate the cutting wheel and, after engaging the first side of tab, the cutter activator is moved away to enable the printer carriage to move past the cutter activator.

12. The apparatus of claim 11, wherein the cutter activator engages a second side of the tab to deactivate the cutting wheel and, after engaging the second side of the tab, the cutter activator is moved away to enable the printer carriage to move past the cutter activator.

13. A method of selectively coupling a device to a printer carriage comprising:

providing a carriage moveable along a travel path including a printing region, the carriage including a printhead and a media cutter;

providing a device located at a parked position;

providing a media cutter actuation mechanism deployed along the travel path between the printing region and the parked position of the device; and optionally actuating the media cutter by causing the carriage to engage the media cutter actuation mechanism, the carriage then returning to the printing region of the travel path with the media cutter being actuated, or optionally causing the carriage to move past the media cutter actuation mechanism and couple to the device; the carriage then returning to the printing region of the travel path without the media cutter being actuated.

* * * * *